US010386743B2

(12) United States Patent
Sakamaki

(10) Patent No.: US 10,386,743 B2
(45) Date of Patent: Aug. 20, 2019

(54) DEVELOPING DEVICE THAT REDUCES THE BENDING OF A DEVELOPER REGULATING MEMBER WHEN THE DEVELOPER REGULATING MEMBER RECEIVES DEVELOPER PRESSURE OR MAGNETIC FORCE

(71) Applicant: CANON KABUSHIKI KAISHA, Tokyo (JP)

(72) Inventor: Tomoyuki Sakamaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/698,461

(22) Filed: Sep. 7, 2017

(65) Prior Publication Data

US 2018/0074433 A1 Mar. 15, 2018

(30) Foreign Application Priority Data

Sep. 12, 2016 (JP) ..... 2016-177990
Jul. 13, 2017 (JP) ..... 2017-137180

(51) Int. Cl.
*G03G 15/08* (2006.01)
*G03G 15/09* (2006.01)

(52) U.S. Cl.
CPC ..... *G03G 15/0812* (2013.01); *G03G 15/09* (2013.01); *G03G 15/0893* (2013.01);
(Continued)

(58) Field of Classification Search
None
See application file for complete search history.

(56) References Cited

U.S. PATENT DOCUMENTS 5,054,419 A * 10/1991 Itaya ..... G03G 15/0812 118/261
2004/0114971 A1* 6/2004 Sakai ..... G03G 15/0812 399/284

(Continued)

FOREIGN PATENT DOCUMENTS

EP 1365294 A2 * 11/2003 ..... G03G 15/0806
JP 08-211745 A 8/1996
JP 2012-203252 A 10/2012

*Primary Examiner* — Walter L Lindsay, Jr.
*Assistant Examiner* — Laura Roth
(74) *Attorney, Agent, or Firm* — Canon U.S.A. Inc., IP Division

(57) ABSTRACT

Warpage of a developer regulating member formed of a magnetic material and unrotatably supported on only both end portions thereof caused when receiving pressure of developer or magnetic force is suppressed. In a cross section of the developer regulating member orthogonal to a rotational axis of the developer beading member, an area of the cross section of the developer regulating member is smaller than 28 $mm^2$, a magnitude of a normal direction component of a second moment of area of the developer regulating member with respect to a centroid of the cross section is larger than 25 $mm^4$, and a magnitude of a tangent direction component of the second moment of area is larger than 70 $mm^4$. The normal direction component and the tangent direction component are respectively components in the normal direction and the tangent direction of the developer bearing member.

11 Claims, 14 Drawing Sheets

| | φ6 ROUND BAR | | TRIANGULAR PRISM (BASE b = 8.5 mm, HEIGHT h = 6.5 mm) | |
|---|---|---|---|---|
| SECOND MOMENT OF AREA IN DIRECTION OF DEVELOPER PRESSURE P | 64 | < | 83 | ($mm^4$) |
| SECOND MOMENT OF AREA IN DIRECTION OF MAGNETIC FORCE F | 64 | < | 65 | ($mm^4$) |
| CROSS-SECTIONAL AREA S (∝ MAGNETIC FORCE F) | 28 | > | 27.5 | ($mm^2$) |

(52) U.S. Cl.
CPC ..... *G03G 2215/0607* (2013.01); *G03G 2215/0609* (2013.01)

(56) References Cited

U.S. PATENT DOCUMENTS

| | | | | |
|---|---|---|---|---|
| 2011/0222918 | A1* | 9/2011 | Ikeda | G03G 15/0812 399/269 |
| 2013/0164042 | A1* | 6/2013 | Watanabe | G03G 15/0189 399/269 |
| 2015/0043950 | A1* | 2/2015 | Yasumoto | G03G 15/0812 399/284 |
| 2016/0238966 | A1* | 8/2016 | Oshikawa | G03G 15/0812 |
| 2017/0090342 | A1* | 3/2017 | Ohhira | G03G 15/0812 |

* cited by examiner

| | ϕ6 ROUND BAR | | ϕ8 SEMI-CYLINDER | |
|---|---|---|---|---|
| SECOND MOMENT OF AREA IN DIRECTION OF DEVELOPER PRESSURE P | 64 | < | 100 | ($mm^4$) |
| SECOND MOMENT OF AREA IN DIRECTION OF MAGNETIC FORCE F | 64 | > | 28 | ($mm^4$) |
| CROSS-SECTIONAL AREA S (∝ MAGNETIC FORCE F) | 28 | > | 25 | ($mm^2$) |

| | φ6 ROUND BAR | | QUADRANGULAR PRISM (BASE b = 6 mm, HEIGHT h = 4 mm) | |
|---|---|---|---|---|
| SECOND MOMENT OF AREA IN DIRECTION OF DEVELOPER PRESSURE P | 64 | < | 72 | ($mm^4$) |
| SECOND MOMENT OF AREA IN DIRECTION OF MAGNETIC FORCE F | 64 | < | 32 | ($mm^4$) |
| CROSS-SECTIONAL AREA S (∝ MAGNETIC FORCE F) | 28 | < | 24 | ($mm^2$) |

| | φ6 ROUND BAR | | φ8 ROUND BAR | |
|---|---|---|---|---|
| SECOND MOMENT OF AREA | 64 | < | 201 | ($mm^4$) |
| CROSS-SECTIONAL AREA S (∝ MAGNETIC FORCE F) | 28 | < | 50 | ($mm^2$) |

DEVELOPING DEVICE THAT REDUCES THE BENDING OF A DEVELOPER REGULATING MEMBER WHEN THE DEVELOPER REGULATING MEMBER RECEIVES DEVELOPER PRESSURE OR MAGNETIC FORCE

BACKGROUND

Field

Aspects of the present invention generally relate to a developing device.

Description of the Related Art

A developing device includes developer bearing member rotatably provided and for bearing two-component developer (hereinafter referred to as "developer") including toner and a magnetic carrier, and a developer regulating member for regulating the amount of developer borne on the developer bearing member.

The publication of Japanese Patent Application Laid-Open No. 2012-203252 discusses a developing device including a indrical developer regulating member of which only both end portions are supported by a developing container and which is composed of a magnetic material.

The developer regulating member composed of a magnetic material receives, in addition to the pressure of developer (hereinafter referred to as "developer pressure") generated by the flow of the developer, magnetic force generated by a magnetic field created by a magnet fixedly placed within a developer bearing member. Particularly, when the developer regulating member of which only both end portions are supported by a developing container and which is composed of a magnetic material receives the developer pressure or the magnetic force, a center portion of the developer regulating member is likely to bend, and the developer regulating member may bend in the longitudinal direction of the developer regulating member. If the developer regulating member bends in the longitudinal direction of the developer regulating member, the size of the gap between the developer regulating member and the developer bearing member in both end portions of the developer regulating member is different from the size of the gap between the developer regulating member and the developer bearing member in the center portion of the developer regulating member. As a result, unevenness may occur to the amount of developer borne on the developer bearing member in the longitudinal direction of the developer bearing member.

In response, to reduce the bending of the developer regulating member when the developer regulating member composed of a magnetic material receives the developer pressure or the magnetic force, it is necessary to secure, in the developer regulating member, sufficient stiffness to withstand the developer pressure or the magnetic force. If the size (the cross-sectional area) of the developer regulating member is made large, it is possible to make the stiffness of the developer regulating member large. If, however, the size of the space for supporting the developer regulating member in the developing container is restricted, there is a limit on making the size (the cross-sectional area) of the developer regulating member large for the purpose of making the stiffness of the developer regulating member large. Meanwhile, in the developer regulating member composed of a magnetic material, the cross-sectional area of the developer regulating member in the direction in which the developer regulating member receives the magnetic force is made small, whereby it is possible to make the magnitude of the magnetic force received by the developer regulating member small.

In response, in a case where the size of the space for supporting in the developing container the developer regulating member of which only both end portions are supported and which is composed of a magnetic material is restricted, it is desirable to employ the following configuration. First, the cross-sectional area of the developer regulating member in the direction in which the developer regulating member receives the magnetic force is made small to make the magnitude of the magnetic force received by the developer regulating member small, thereby securing, in the developer regulating member, sufficient stiffness to withstand the magnetic force received by the developer regulating member composed of a magnetic substance. Second, the cross-sectional area of the developer regulating member in the direction in which the developer regulating member receives the developer pressure is made large according to the reduction in the cross-sectional area of the developer regulating member in the direction in which the developer regulating member receives the magnetic force, thereby securing, in the developer regulating member, sufficient stiffness to withstand the developer pressure received by the developer regulating member of which only both end portions are supported.

SUMMARY

Aspects of the present invention are generally directed to, in a case where the size of the space for supporting in a developing container a developer regulating member of which only both end portions are supported and which is composed of a magnetic material is restricted, reducing the bending of the developer regulating member when the developer regulating member receives developer pressure or magnetic force.

According to an aspect of the present invention, a developing device includes a developing container configured to store developer including toner and a magnetic carrier, a developer bearing member rotatably provided and configured to bear the developer to develop an electrostatic latent image formed on an image bearing member, a magnet fixedly placed within the developer bearing member and configured to generate a magnetic field for the developer bearing member to bear the developer, and a developer regulating member placed not in contact with the developer bearing member so as to be opposed to the developer bearing member, configured to be magnetized by an external magnetic field, and configured to regulate an amount of developer borne on the developer bearing member, wherein only both end portions of the developer regulating member are supported by the developing container such that the developer regulating member cannot rotate, wherein a size of an area of a cross section orthogonal to a rotational axis of the developer bearing member of the developer regulating member is smaller than 28 $mm^2$, wherein a magnitude of a second moment of area in a normal direction of the developer bearing member with respect to a centroid of the cross section orthogonal to the rotational axis of the developer bearing member of the developer regulating member is larger than 25 $mm^4$, and wherein a magnitude of a second moment of area in a tangent direction of the developer bearing member with respect to the centroid of the cross section orthogonal to the rotational axis of the developer bearing member of the developer regulating member is larger than 70 $mm^4$.

Further features of aspects of the present invention will become apparent from the following description of exemplary embodiments with reference to the attached drawings.

DESCRIPTION OF THE EMBODIMENTS

Exemplary embodiments of the present invention will be described in detail below with reference to the accompanying drawings. The following exemplary embodiments do not limit the present invention according to the appended claims, and not all the combinations of the features described in the exemplary embodiments are essential for a method for solving the problems in the present invention. Aspects of the present invention can be carried out in various applications such as printers, various printing machines, copying machines, faxes, and multifunction peripherals.

(Configuration of Image Forming Apparatus)

Figure 1:
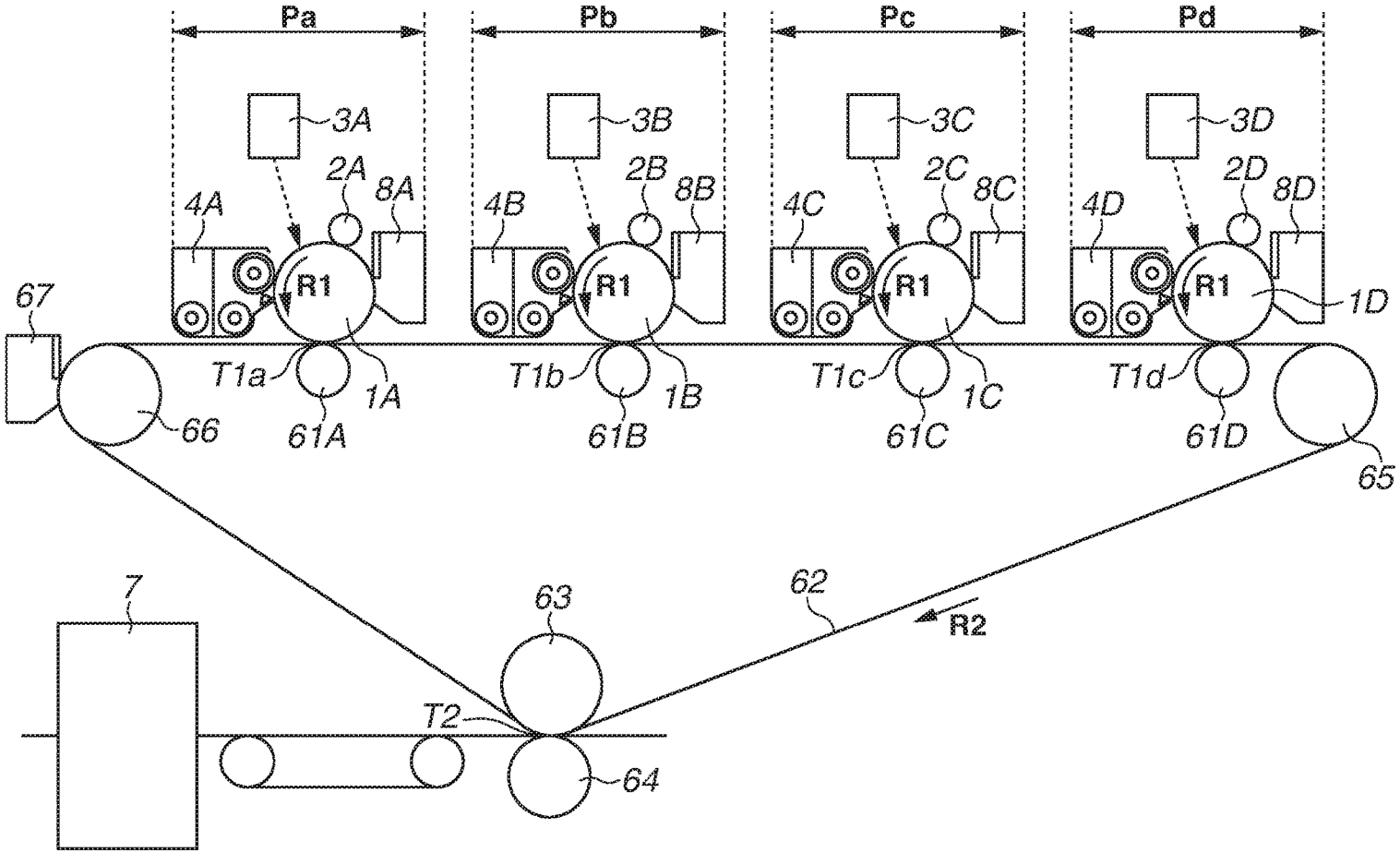
FIG. 1 is a cross-sectional view illustrating a configuration of an image forming apparatus according to a first exemplary embodiment.

First, with reference to a cross-sectional view in FIG. 1, the configuration of an image forming apparatus according to a first exemplary embodiment of the present invention is described.

As illustrated in FIG. 1, the image forming apparatus includes an endless intermediate transfer belt (ITB) 62 as an intermediate transfer member and also includes four image forming units P (Pa, Ph, Pc, Pd) from the upstream side to the downstream side in the rotational direction of the intermediate transfer belt 62 (the direction of an arrow R2 illustrated in FIG. 1).

In the first exemplary embodiment, the following description is given using a tandem-type intermediate transfer full-color printer as an example of the image forming apparatus. Alternatively, any of the combinations of a single-drum type or a tandem type, a direct transfer method or an intermediate transfer method, and a full-color printer or a monochrome printer may be employed.

The image forming units P (Pa, Pb, Pc, Pd) form toner images of yellow (Y), magenta (M), cyan (C), and black (Bk) colors. Each image forming unit P (Pa, Pb, Pc, Pd) includes a rotatable photosensitive drum 1 (1A, 1B, 1C, 1D) as an image bearing member. In the first exemplary embodiment, the following description is given using a drum-like organic photosensitive member as an example of the photosensitive drum 1 (1A, 1B, 1C, 1D). Alternatively, the photosensitive drum 1 (1A, 1B, 1C, 1D) may be an inorganic photosensitive member such s an amorphous silicon photosensitive member, and may be a belt-like photosensitive member. Further, a charging method, a developing method, a transfer method, a cleaning method, and a fixing method are not limited to the methods described below, either.

The photosensitive drum 1 (1A, 1B, 1C, 1D) is driven to rotate in its rotational direction (the direction of an arrow R1 illustrated in FIG. 1) at a predetermined process speed. Around the photosensitive drum 1 (1A, 1B, 1C, 1D), a charging device 2 (2A, 2B, 2C, 2D) as a charging unit and an exposure device 3 (3A, 3B, 3C, 3D) as a latent image formation unit are disposed along the rotational direction of the photosensitive drum 1. Further, around the photosensitive drum 1 (1A, 1B, 1C, 1D), a developing device 4 (4A, 4B, 4C, 4D) as a developing unit and a primary transfer roller 61 (61A, 61B, 61C, 61D) as a primary transfer unit are disposed along the rotational direction of the photosensitive drum 1. Further, around the photosensitive drum 1 (1A, 1B, 1C, 1D), a photosensitive member cleaning device 8 (8A, 8B, 8C, 8D) a photosensitive member cleaner for collecting toner that has not been primarily transferred onto the intermediate transfer belt 62 and remains on the photosensitive drum 1 is disposed.

Each developing device 4 (4A, 4B, 4C, 4D) is attachable to and detachable from the image forming apparatus. Further, the developing device 4 (4A, 4B, 4C, 4D) includes a developing container for storing developer. The details of the developing device 4 will be described below with reference to FIGS. 2 to 4.

On the photosensitive drum 1 (1A, 1B, 1C, 1D), a photosensitive layer is formed by providing a negative charge polarity for the outer peripheral surface of an aluminum cylinder. The charging device 2 (2A, 2B, 2C, 2D) charges the surface of the photosensitive drum 1 (1A, 1B, 1C, 1D) to a dark potential Vd [V], which has a uniform negative polarity. Next, the exposure device 3 (3A, 3B, 3C, 3D) scans a laser beam using a rotating mirror, thereby drawing an electrostatic image (an electrostatic latent image) of an image on the surface of the charged photosensitive drum 1 (1A, 1B, 1C, 1D). The developing device 4 (4A, 4B, 4C, 4D) develops the electrostatic latent image using developer, thereby forming a toner image on the surface of the photosensitive drum 1 (1A, 1B, 1C, 1D).

The intermediate transfer belt 62 is stretched around primary transfer rollers 61 (61A, 61B, 61C, 61D), a tension roller 65, a secondary transfer opposing roller 63, and a tension roller 66.

Each primary transfer roller 61 (61A, 61B, 61C, 61D) presses the inner surface of the intermediate transfer belt 62, thereby forming a transfer unit for a toner image between the photosensitive drum 1 (1A, 1B, 1C, 1D) and the intermediate transfer belt 62. This transfer unit is a primary transfer nip portion T1 (T1*a*, T1*b*, T1*c*, T1*d*) as a primary transfer unit. Then, a direct current voltage having a positive polarity is applied to the primary transfer roller 61 (61A, 61B, 61C, 61D), thereby primarily transferring the toner image having a negative polarity borne on the photosensitive drum 1 (1A, 1B, 1C, 1D) onto the intermediate transfer belt 62.

The secondary transfer opposing roller 63 doubles as a driving roller, and according to the rotation of the secondary transfer opposing roller 63, the intermediate transfer belt 62 rotates in rotational direction (the direction of the arrow R2). The rotational speed of the intermediate transfer belt 62 is set to be approximately the same as the rotational speed (the process speed) of each photosensitive drum 1 (1A, 1B, 1C, 1D).

At a position on the surface of the intermediate transfer belt 62 and corresponding to the secondary transfer opposing roller 63, a secondary transfer roller 64 serving as a secondary transfer unit is disposed. The intermediate transfer belt 62 is nipped between the secondary transfer opposing roller 63 and the secondary transfer roller 64. Consequently, a secondary transfer nip portion T2 serving as a secondary transfer unit is formed between the secondary transfer roller 64 and the intermediate transfer belt 62.

Further, at a position on the surface of the intermediate transfer belt 62 and corresponding to the tension roller 66, a belt cleaner 67 serving as an intermediate transfer member cleaner for collecting toner that has not been secondarily transferred onto a recording material and remains on the intermediate transfer belt 62 is in contact with the intermediate transfer belt 62.

Recording materials (e.g., sheets such as paper or transparent films) to be supplied for image formation by the image forming unit P (Pa, Pb, Pc, Pd) are stored in a stacked state in a feeding cassette serving as a sheet storage unit. Then, recording materials taken out from the feeding cassette by a pickup roller are separated one y one by a separation roller, and each recording material is fed to a registration roller. The registration roller sends the recording material to the secondary transfer nip portion T2 in timing with the toner image on the intermediate transfer belt 62.

Further downstream in the conveying direction of the recording material than the secondary transfer nip portion T2, a fixing device 7 is disposed, which includes a fixing unit and a pressure unit. Further downstream in the conveying direction of the recording material than the fixing device 7, a discharge tray for stacking recording materials discharged to outside the apparatus is disposed. The recording material onto which the toner image has been transferred is heated and pressurized by the fixing device 7, whereby the toner image is fixed to the surface of the recording material. Then, the recording material to the surface of which the toner image is fixed is discharged to the discharge tray.

(Configuration of Developing Device)

Figure 2:
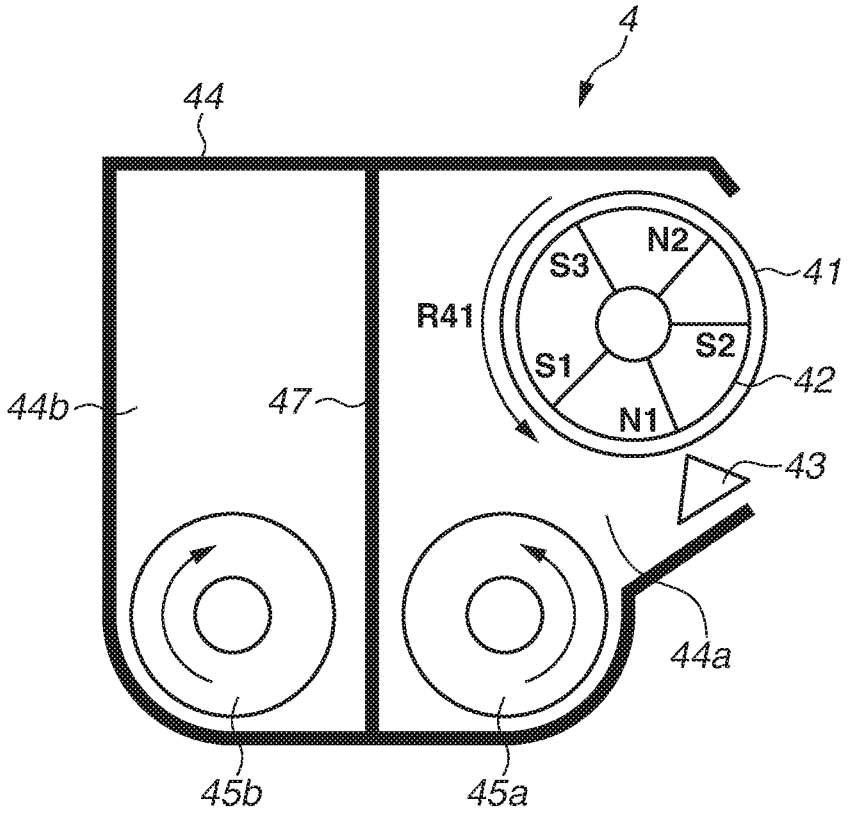
FIG. 2 is a cross-sectional view illustrating a configuration of a developing device according to the first exemplary embodiment.
Figure 3:
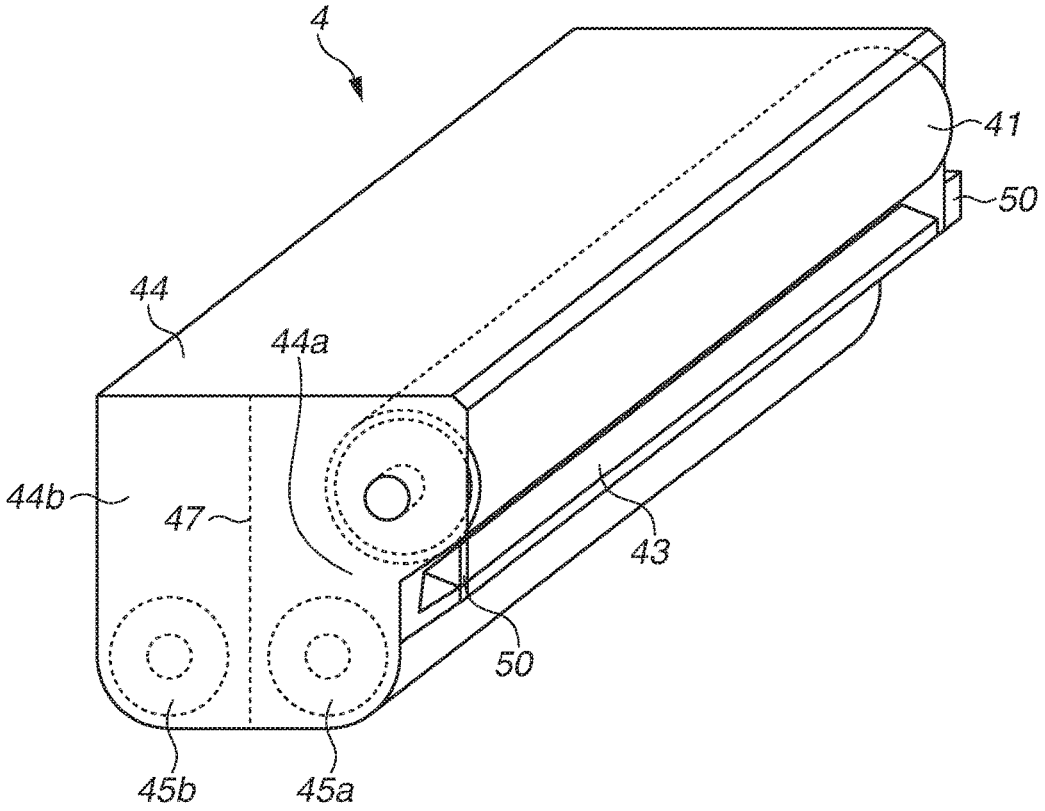
FIG. 3 is a perspective view illustrating the configuration of the developing device according to the first exemplary embodiment.
Figure 4:
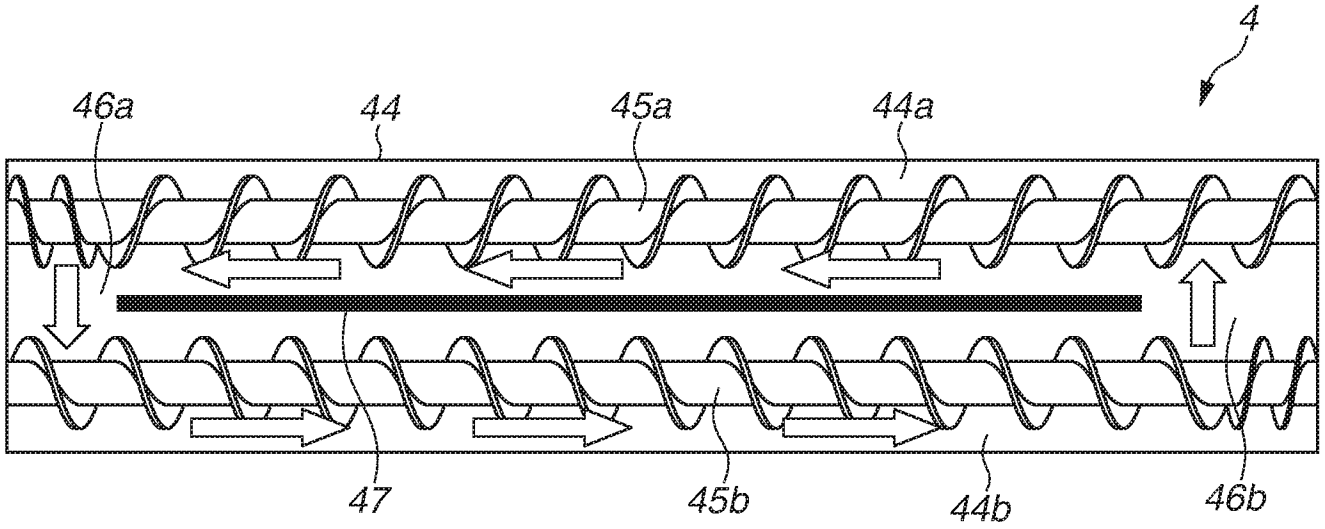
FIG. 4 is a schematic diagram illustrating the configuration of the developing device according to the first exemplary embodiment.

Next, with reference to a cross-sectional view in FIG. 2, a perspective view in FIG. 3, and a schematic diagram in FIG. 4, the configuration of the developing device 4 is described.

The developing device 4 includes a developing container 44, which stores developer. In the developing container 44, a developing sleeve 41 serving as a developer bearing member bearing developer, and a developer regulating member 43, which regulates the amount of developer borne on the surface of the developing sleeve 41, are disposed.

The developer regulating member 43 functions to form a thin layer of developer on the surface of the developing sleeve 41.

In the first exemplary embodiment, the following description is given using, as an example of the developer regulating member 43, a developer regulating member resin-molded using a resin material. Alternatively, the developer regulating member 43 may be a developer regulating member using a metal material such as stainless steel (SUS). The developer regulating member 43 is resin-molded, whereby it is possible to relatively easily manufacture even a complex shape. It is desirable to select, as the resin material for use in the developer regulating member 43, a resin material having relatively high stiffness, such as a polycarbonate (PC)+acrylonitrile styrene (AS) resin material or a polycarbonate (PC)+acrylonitrile butadiene styrene (ABS) resin material. A metal material is generally a magnetic material, whereas a resin material is generally a nonmagnetic material. Thus, to manufacture a developer regulating member made of a resin to be magnetized by an external magnetic field, a product obtained by mixing a resin, which is a nonmagnetic material, with a magnetic powder, which is a magnetic material, is resin-molded.

In the first exemplary embodiment, the developing sleeve 41 is composed of aluminum, which is a nonmagnetic material. The developing sleeve 41 may be composed of stainless steel so long as a nonmagnetic material is used. In the first exemplary embodiment, the developing sleeve 41 having a diameter of 18 mm (ø18) is used.

Within the developing sleeve 41, a magnet 42 serving as a magnetic field generation unit having a plurality of magnetic poles is fixedly placed along the circumferential direction of the developing sleeve 41. The developing sleeve 41 rotates counterclockwise (in the direction of an arrow R41 illustrated in FIG. 2) in an outer circumferential portion of the magnet 42. The width at which developer is borne on the developing sleeve 41 (hereinafter referred to as a "developer bearing region") in the axial direction of the rotational axis of the developing sleeve 41 (hereinafter referred to as "the longitudinal direction of the developing sleeve 41") is approximately the same as the width in the longitudinal direction of the magnet 42.

In the developing container 44, a developing chamber 44*a* and an agitation chamber 44*b* are disposed to be arranged side by side in the horizontal direction. Further, in the developing container 44, a partition wall 47 is provided, which partitions the developing chamber 44*a* and the agitation chamber 44*b*. Developer detached from the developing sleeve 41 is collected in the developing chamber 44*a*. Then, the developer collected in the developing chamber 44*a* is supplied to the developing sleeve 41 again in the developing chamber 44*a*.

In the longitudinal direction of the developing sleeve 41 and at a position corresponding to a region of the developing sleeve 41 (hereinafter referred to as a "developing region") opposed to the photosensitive drum 1, an opening portion is provided in the developing chamber 44*a*. The developing sleeve 41 is rotatably placed so that a part of the developing sleeve 41 is exposed through this opening portion.

In the developing chamber 44*a*, a first conveying screw 45*a* serving as a first developer conveying member for agitating and conveying developer in the developing chamber 44*a* is rotatably provided. Further, in the agitation chamber 44*b*, a second conveying screw 45*b* serving as a second developer conveying member for agitating and conveying developer in the agitation chamber 44*b* is rotatably provided. The second conveying screw 45*b* agitates developer supplied by a developer resupply mechanism (a hopper) for resupplying developer, and developer already present in the agitation chamber 44*b*, and conveys the resulting developer. The first conveying screw 45*a* and the second conveying screw 45*b* convey developer in directions opposite to each other and circulate developer in the developing container 44 in a circulation path for developer.

As illustrated in FIG. 4, developer conveyed by the first conveying screw 45*a* is delivered from the developing chamber 44*a* to the agitation chamber 44*b* through a communication portion 46*a*. Further, developer conveyed by the second conveying screw 45*b* is delivered from the agitation chamber 44*b* to the developing chamber 44*a* through a communication portion 46*b*.

Developer stored in the developing container 44 is two-component developer obtained by mixing nonmagnetic toner capable of being negatively charged and a magnetic carrier. The nonmagnetic toner is obtained as a powder by pulverizing or polymerizing a resin such as polyester or styrene containing a coloring agent and a wax component. The magnetic carrier is obtained by coating with a resin the surface layer of a core made of resin particles obtained by mixing and kneading ferrite particles and a magnetic powder.

(Developing Process)

Next, a description is given of the process of developing an electrostatic latent image on the surface of the photosensitive drum 1 (a developing process).

The surface of the photosensitive drum is uniformly charged to a charge potential (a dark potential) Vd [V] by the charging device 2. Then, a portion on the surface of the photosensitive drum 1 and corresponding to an image portion is exposed by the exposure device 3, thereby obtaining an exposure potential (a light potential) Vl [V] To the developing sleeve 41, a direct current voltage or a voltage obtained by superimposing an alternating current voltage on a direct current voltage is applied. When the voltage of a direct current component of the developing sleeve 41 is Vdc, an absolute value [Vdc−Vl] of the difference between the voltage of the direct current component of the developing sleeve 41 and the exposure potential is referred to as "Vcont". By this Vcont, an electric field for carrying toner to the image portion on the surface of the photosensitive drum 1 is formed. Further, an absolute value [Vdc−Vd] of the difference between the voltage Vdc of the direct current component of the developing sleeve 41 and the charge potential Vd is referred to as "Vback". By this Vback, an electric field for pulling back toner from the surface of the photosensitive drum 1 in the direction of the developing sleeve 41 is formed.

(Configuration of Developing Sleeve)

Next, the developing sleeve 41 is described. The magnet 42 according to the first exemplary embodiment includes five magnet pieces. As illustrated in FIG. 2, within the developing sleeve 41, the magnet 42 is placed, in which a plurality of magnetic poles S1, N1, S2, N2, and S3 are placed and which is supported in a non-rotatable manner. The magnetic pole N1 (a cut pole) is placed to be approximately opposed to the developer regulating member 43. That is, the developer regulating member 43 is placed to be opposed to the surface of the developing sleeve 41 in the range of ±10 degrees in the rotational direction of the developing sleeve 41 with the position of a local maximum peak of the magnetic flux density of the magnetic pole N1 (the cut pole) at its center. Further, the magnetic pole S3 (a tear-off pole) and the magnetic pole S1 (a scoop-up pole) are placed to be opposed to the developing chamber 44*a*.

First, developer is scooped up at the position of the magnetic pole S1, which is created around a first magnet piece. Then, the developer attached at the position of the magnetic pole S1 is conveyed in the direction of the developer regulating member 43 according to the rotation of the developing sleeve 41. Next, the developer is napped by the magnetic pole N1, which is created around second magnet piece, and the layer thickness of the developer borne on the surface of the developing sleeve 41 is regulated by the developer regulating member 43. Then, the developer passes between the developing sleeve 41 and the developer regulating member 43 according to the rotation of the developing sleeve 41, whereby a developer layer having a predetermined layer thickness is formed on the surface of the developing sleeve 41. Then, the developer of the developer layer formed on the surface of the developing sleeve 41 is conveyed to the developing region according to the rotation of the developing sleeve 41.

In the first exemplary embodiment, the gap between the developing sleeve 41 and the developer regulating member 43 (hereinafter referred to as an "SB gap") is set to 500 μm. The SB gap refers to the shortest distance between the developing sleeve 41 and the developer regulating member 43. The SB gap is adjusted, whereby it is possible to adjust the amount of developer on the surface of the developing sleeve 41 to be conveyed to the developing region.

Next, by the magnetic pole S2, which is created around a third magnet piece, magnetic nap (a magnetic brush) comes into contact with the surface of the photosensitive drum 1. This develops an electrostatic latent image on the photosensitive drum 1. In the first exemplary embodiment, the gap between the developing sleeve 41 and the photosensitive drum 1 (hereinafter referred to as an "SD gap") is set to 300 μm. The SD gap refers to the shortest distance between the developing sleeve 41 and the photosensitive drum 1.

Then, the developer after being supplied for the development passes through the magnetic pole N2 (a conveyance pole), which is created around a fourth magnet piece, and is separated from the developing sleeve 41 in a separation region. This separation region results from a reaction magnetic field formed by the magnetic pole S3 (the tear-off pole), which is created around a fifth magnet piece, and the magnetic pole S1 (the scoop-up pole).

(Configuration of Developer Regulating Member)

Next, the developer regulating member 43 is described. The developer regulating member 43 according to the first exemplary embodiment is composed of a magnetic substance material. Specifically, the developer regulating member 43 is composed of a magnetic low-carbon steel material in the state of t cold-rolled steel sheet (SPCC) and has a relative magnetic permeability of about 2000 to 6000.

If the developer regulating member 43 is composed of a magnetic substance, the lines of magnetic force generated by a magnetic field created by the magnet 42 are dense on the surface of an extremity portion of the developer regulating member 43 opposed to the surface of the developing sleeve 41, and developer including a magnetic carrier is magnetically attracted. Then, if the developer is attached to the surface of the developer regulating member 43, the developer attached to the surface of the developer regulating member 43 blocks a part of the SB gap. When the developer is attached to the surface of the developer regulating member 43, the SB gap is relatively smaller and the amount of regulating the developer passing through the SB gap is larger than when the developer is not attached to the surface of the developer regulating member 43. That is, in a case where the developer regulating member 43 is composed of a magnetic substance, the ability to regulate the conveyance of developer borne on the surface of the developing sleeve 41 in the longitudinal direction of the developing sleeve 41 is greater than a case where the developer regulating member 43 is composed of a nonmagnetic substance.

Thus, regarding the size of the SB gap to be adjusted so that developer to be conveyed to the developing region has a predetermined amount, it is possible to set the SB gap to be larger in a case where the developer regulating member 43 is composed of a magnetic substance than in a case where the developer regulating member 43 is composed of a nonmagnetic substance. If the SB gap can be set to be large, foreign matter such as toner aggregates, fibers, and paper dust is less likely to be stuck between the developer regulating member 43 and the developing sleeve 41. This reduces the occurrence of unevenness in the amount of developer borne on the surface of the developing sleeve 41 in the longitudinal direction of the developing sleeve 41 due to the fact that foreign matter such as toner aggregates, fibers, and paper dust is stuck between the developer regulating member 43 and the developing sleeve 41.

The developer regulating member 43 according to the first exemplary embodiment does not have a plate shape (a blade shape), but has a bar shape. For example, in a case where the developer regulating member 43 has a plate shape using a metal material such as stainless steel (SUS), two points in a supporting plate for supporting the developer regulating member 43 are screwed to the developing container 44, whereby it is possible to position the developer regulating member 43 relative to the developing container 44. Further, for example, in a case where the developer regulating member 43 has a plate shape using a resin material, the developer regulating member 43 is bonded with the developing container 44 using an adhesive, whereby it is possible to position the developer regulating member 43 relative to the developing container 44.

On the other hand, in a case where the developer regulating member 43 has a bar shape, it is difficult to position the developer regulating member 43 relative to the developing container 44 by screwing or an adhesive. In response, in a case where the developer regulating member 43 has a bar shape, the developer regulating member 43 is supported by a supporting portion 50 in the longitudinal direction of the developer regulating member 43. At this time, a center portion of the developer regulating member 43 is not supported by the supporting portion 50, and both end portions of the developer regulating member 43 are supported by the supporting portion 50, whereby, as illustrated in FIG. 3, the developer regulating member 43 is positioned as not to rotate relative to the developing container 44.

In the first exemplary embodiment, the following description is given on the assumption that the developer regulating member 43 is composed of a magnetic substance and has a bar shape. In such a configuration of the developer regulating member 43, it is necessary to take into account the influences of the deformation of the developer regulating member 43 due to the fact that the developer regulating member 43 receives developer pressure P, and the deformation of the developer regulating member 43 due to the fact that the developer regulating member 43 receives magnetic force F.

This is because in a case where the developer regulating member 43 is composed of a nonmagnetic substance, the developer regulating member 43 does not receive the magnetic force F, but in a case where the developer regulating member 43 is composed of a magnetic substance, the developer regulating member 43 receives the magnetic force F. Further, in a case where the developer regulating member 43 has a plate shape (a blade shape), a center portion of the developer regulating member 43 is fixed by screwing or an adhesive, but in a case where the developer regulating member 43 has a bar shape, a center portion of the developer regulating member 43 is not supported by the supporting portion 50. Thus, in a case where the developer regulating member 43 is composed of a magnetic substance and has a bar shape, and if the developer regulating member 43 receives the developer pressure P or the magnetic force F, the developer regulating member 43 may deform and bend in the longitudinal direction of the developer regulating member 43.

First, the developer pressure P on the developer regulating member 43 is described.

In the process in which developer passes between the developing sleeve 41 and the developer regulating member 43 according to the rotation of the developing sleeve 41, the developer needs to be stably supplied to the developing region. In response, in a portion of the developing sleeve 41 opposed to the developer regulating member 43, the magnetic pole N1 (the cut pole) of the magnet 42 is approximately opposed to the developer regulating member 43, thereby forming developer storage. The developer regulating member 43 regulates the amount of developer on this developer storage. Consequently, it is always possible to secure a constant amount of developer in a portion immediately upstream of the developer regulating member 43. Thus, it is possible to stably supply developer to the developing region.

Figure 5:
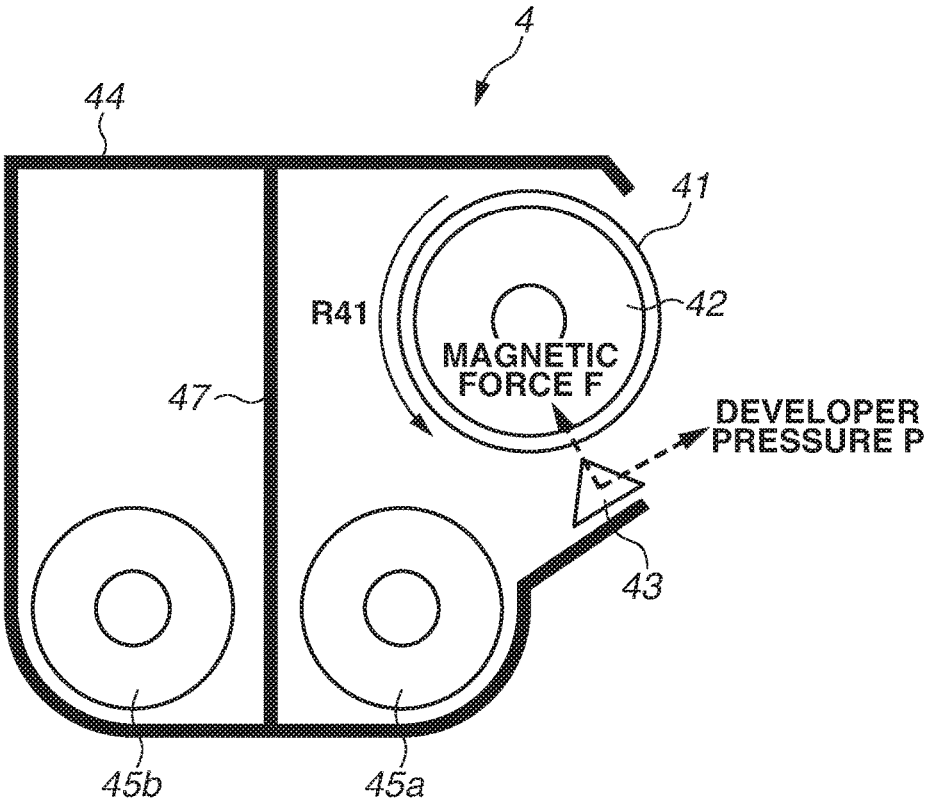
FIG. 5 is a cross-sectional view illustrating the configuration of the developing device according to the first exemplary embodiment.

Meanwhile, if the configuration is employed in which in the portion of the developing sleeve 41 opposed to the developer regulating member 43, the magnetic pole N1 (the cut pole) of the magnet 42 is approximately opposed to the developer regulating member 43, thereby forming developer storage, the developer pressure P of developer is likely to be applied to the developer regulating member 43. At this time, according to the rotation of the developing sleeve 41, the developer pressure P is mainly applied in the rotational direction of the developing sleeve 41. That is, as illustrated in FIG. 5, the developer pressure P is applied in the tangent direction of the portion of the developing sleeve 41 opposed to the developer regulating member 43 (hereinafter referred to as "the tangent direction of the developing sleeve 41"). Then, the developer regulating member 43 receives the developer pressure P in the tangent direction of the developing sleeve 41.

Next, the magnetic force F on the developer regulating member 43 is described.

As described above, in the portion of the developing sleeve 41 opposed to the developer regulating member 43, the magnetic pole N1 (the cut pole) of the magnet 42 is approximately opposed to the developer regulating member 43. Since the developer regulating member 43 according to the first exemplary embodiment is composed of a magnetic substance, the magnetic force F is applied in a direction toward the magnetic pole N1 (the cut pole). That is, as illustrated in FIG. 5, the magnetic force F is applied in the normal direction of the portion of the developing sleeve 41 opposed to the developer regulating member 43 (hereinafter referred to as the normal direction of the developing sleeve 41").

As described above, in a case where the developer regulating member 43 is composed of a magnetic substance and has a bar shape, and if the developer regulating member 43 receives the develop pressure P or the magnetic force F, the developer regulating member 43 may deform and bend in the longitudinal direction of the develop regulating member 43. Then, the bending of the developer regulating member 43 makes the size of the SB gap in both end portions of the developer regulating member 43 different from the size of the SB gap in the center portion of the developer regulating member 43. If the size of the SB gap in both end portions of the develop regulating member 43 is different from the size of the SB gap in the center portion of the developer regulating member 43, unevenness may occur to the amount of developer borne on the surface of the developing sleeve 41 in the longitudinal direction of the developing sleeve 41.

The magnitude of the developer pressure P received by the developer regulating member 43 composed of a magnetic substance does not change regardless of the cross-sectional shape of the developer regulating member 43, but the magnitude of the magnetic force F received by the developer regulating member 43 composed of a magnetic substance can be changed according to the cross-sectional shape of the developer regulating member 43. That is, the shape of the developer regulating member 43 is set so that the magnitude of the magnetic force F received by the developer regulating member 43 composed of a magnetic substance is small, whereby it is possible to reduce the degree of increase in the stiffness of the developer regulating member 43 in the direction of the magnetic force F.

In response, in a case where the size of the space for supporting in the developing container 44 the developer regulating member 43 of which only both end portions are supported and which is composed of a magnetic material is restricted, it is desirable to employ the following configuration. First, the cross-sectional area of the developer regulating member 43 in the direction in which the developer regulating member 43 receives the magnetic force F is made small to make the magnitude of the magnetic force F received by the developer regulating member 43 small, thereby securing, in the developer regulating member 43, sufficient stiffness to withstand the magnetic force F received by the developer regulating member 43 composed of a magnetic substance. Second, the cross-sectional area of the developer regulating member 43 in the direction in which the developer regulating member 43 receives the developer pressure P is made large according to the reduction in the cross-sectional area of the developer regulating member 43 in the direction in which the developer regulating member 43 receives the magnetic force F, thereby securing, in the developer regulating member 43, sufficient stiffness to withstand the developer pressure P received by the developer regulating member 43 of which only both end portions are supported.

For example, suppose that due to a restriction on the size of the space for supporting in the developing container 44 the developer regulating member 43 of which only both end portions are supported and which is composed of a magnetic material, the size of the cross-sectional area of the developer regulating member 43 composed of a magnetic substance when viewed in a cross section orthogonal to the direction of the rotational axis of the developing sleeve 41 needs to be made smaller than 28 $mm^2$.

In response, for example, in the developer regulating member 43 which is cylindrical with a diameter of 7 mm and made of a metal, a part of the surface of the developer regulating member 43 is cut so that the magnitude of the magnetic force F received by the developer regulating member 43 is small, whereby the size of the cross-sectional area of the developer regulating member 43 composed of a magnetic substance is smaller than 28 $mm^2$. Consequently, the developer regulating member 43 which is cylindrical with diameter of 7 mm and made of a metal (although a part of the surface of the developer regulating member 43 is cut) can be attached to a predetermined space for supporting the developer regulating member 43. Further, since the magnitude of the magnetic force F received by the developer regulating member 43 becomes small, it is possible to secure, in the developer regulating member 43, sufficient stiffness to withstand the magnetic force F received by the developer regulating member 43 composed of a magnetic substance.

Further, since the developer regulating member 43 is cylindrical with a diameter of 7 mm and made of a metal (although a part of the surface of the developer regulating member 43 is cut), the cross-sectional area of the developer regulating member 43 in the direction in which the developer regulating member 43 receives the developer pressure P is larger than that of a developer regulating member which is cylindrical with a diameter of 6 mm and made of a metal. Consequently, it is possible to secure, in the developer regulating member 43, sufficient stiffness to withstand the developer pressure P received by the developer regulating member 43 of which only both end portions are supported.

In the first exemplary embodiment, in the developer regulating member 43 of which only both end portions are supported and which is composed of a magnetic substance, an apparatus is prevented from becoming large, while, even if the developer regulating member 43 receives the developer pressure P or the magnetic force F, the bending of the developer regulating member 43 in the longitudinal direction of the developer regulating member 43 is reduced. The details are described below.

In the first exemplary embodiment, in the longitudinal direction of the developer regulating member 43, the center portion of the developer regulating member 43 is not supported by the supporting portion 50, and both end portions of the developer regulating member 43 are supported by the supporting portion 50, whereby the developer regulating member 43 is positioned relative to the developing container 44. At this time, the developer regulating member 43 receives the developer pressure P that is uniformly distributed (not locally concentrated). Such a situation corresponds to "a both-end supported beam subjected to a uniformly distributed load" in the field of strength of materials. At this time, the amount of bending (displacement) Δ of the developer regulating member 43 is represented by the following formula.

$$\Delta = \frac{5}{384}\frac{qL^4}{EI}$$

In this formula, q represents the magnitude of the uniformly distributed load, L represents the length of the beam, E represents an elasticity coefficient, and I represents a second moment of area.

To reduce the deformation of the developer regulating member 43 due to the fact that the developer regulating member 43 receives—the developer pressure P or the magnetic force F, it is possible to make the second moment of area of the developer regulating member 43 large to increase the stiffness of the developer regulating member 43. Meanwhile, if the cross-sectional area of the developer regulating member 43 is simply made large to make the second moment of area of the developer regulating member 43 large, the magnetic force F received by the developer regulating member 43 becomes large according to the increase in the cross-sectional area of the developer regulating member 43. In response, in the first exemplary embodiment, the cross-sectional shape of the developer regulating member 43 is set to make the second moment of area of the developer regulating member 43 large, while preventing the magnetic force F received by the developer regulating member 43 from becoming large. This reduces the deformation (bending) of the developer regulating member 43 due to the fact that the developer regulating member 43 receives the developer pressure P or the magnetic force F.

The developer pressure P and the magnetic force F are represented as q (the magnitude of the uniformly distributed load). Between these, if the magnetic flux density created by the magnet 42 is B, the magnetic force F is represented by the following formula.

$$F=M\nabla B$$

In this formula, M represents the sum of magnetic moments induced by the presence of the developer regulating member 43 composed of a magnetic substance in a magnetic field and is referred to as "magnetization M". Generally, the magnetization M has magnetization proportional to an external magnetic field and is represented by the following formula.

$$M=|A|B$$

In this formula, |A| is a function including magnetic permeability and is proportional to a volume V of the magnetic substance (|A|=|a|×V). Thus, the magnetic force F is represented by the following formula.

$$\begin{aligned} F &= M\nabla B \\ &= |A|B\nabla B \\ &= -|A|\nabla|B|^2 \\ &= -|a|V\nabla|B|^2 \end{aligned}$$

Consequently, the magnetic force F is proportional to the volume V (the cross-sectional area) of the magnetic substance. That is, the cross-sectional area of the developer regulating member 43 is made small, whereby it is possible to make the magnetic force F small.

Figure 14:
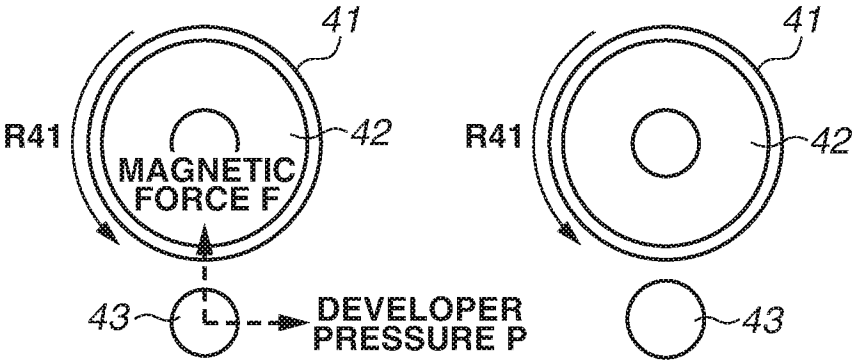
FIG. 14 is a cross-sectional view illustrating a shape of a developer regulating member as a comparative example.

At this time, as illustrated in FIG. 14, in a case where the shape of the cross section of the developer regulating member 43 is a circle (i.e., the developer regulating member 43 is a round bar cylinder), and if the diameter of the circle is d, the second moment of area I of the developer regulating member 43 is represented by the following formula.

$$I = \frac{\pi d^4}{64}$$

The diameter of the circle that is the shape of the cross section of the developer regulating member 43 is increased from 6 mm (ø6) to 8 mm (ø8), whereby it is possible to make the second moment of area of the developer regulating member 43 large.

Then, the second moment of area of the developer regulating member 43 is made large, whereby it is possible to increase the stiffness of the developer regulating member 43 to reduce the deformation (bending) of the developer regulating member 43.

However, in a case where the developer regulating member 43 is composed of a magnetic substance, and if the diameter of the circle that is the shape of the cross section of the developer regulating member 43 is made large, the cross-sectional area of the developer regulating member 43 becomes large. As described above, the magnetic force F is proportional to the magnitude of the volume V (the cross-sectional area) of the magnetic substance. Thus, if the cross-sectional area of the developer regulating member becomes large, the magnetic force F received by the developer regulating member 43 becomes large.

As illustrated in FIG. 14, the second moment of area of the developer regulating member 43 of which the shape of the cross section is a circle and the cross-sectional area of the developer regulating member 43 are as illustrated in table 1.

TABLE 1

| | ø6 round bar | ø8 round bar |
|---|---|---|
| Second moment of area | 64 | 201 |
| Cross-sectional area of developer regulating member | 28 | 50 |

In a case where the shape of the cross section of the developer regulating member 43 is a circle, then to secure, in the developer regulating member 43, sufficient stiffness to withstand the magnetic force F even if the developer regulating member 43 receives the magnetic force F proportional to the magnitude of the volume V of the magnetic substance, the cross-sectional area of the developer regulating member 43 needs to be made large.

If, however, the cross-sectional area of the developer regulating member 43 becomes large, the size itself of the developer regulating member 43 becomes large. Thus, a wide space for placing the developer regulating member 43 in the developing container 44 needs to be provided within the apparatus. This results in making the apparatus large.

Figure 6:
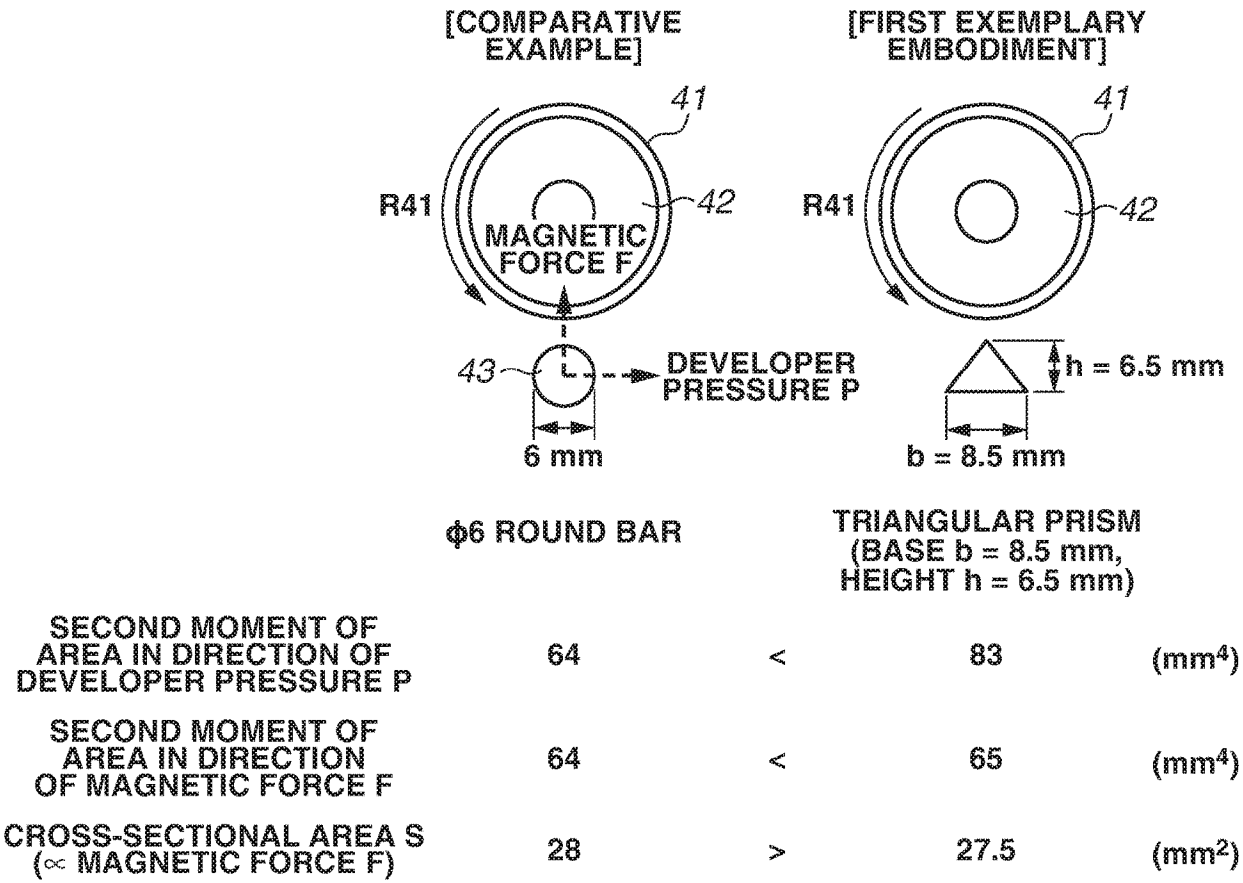
FIG. 6 is a cross-sectional view illustrating a shape of a developer regulating member according to the first exemplary embodiment.

In response, in the first exemplary embodiment, as illustrated in FIG. 6, the shape of the cross section of the developer regulating member 43 is an isosceles triangle having a base b of 8.5 mm and a height h of 6.5 mm (i.e., the developer regulating member 43 is a triangular prism). Further, the developer regulating member 43 is placed relative to the developing sleeve 41 such that an apex portion of the isosceles triangle of the cross section of the developer regulating member 43 is opposed to the developing sleeve 41.

In a case where the shape of the cross section of the developer regulating member 43 is a triangle, unlike a case where the shape of the cross section of the developer regulating member 43 is a circle, the second moment of area of the developer regulating member 43 differs depending on the direction. That is, in a case where the shape of the cross section of the developer regulating member 43 is a triangle, a second moment of area Iz in the direction of the developer pressure P and a second moment of area Ix in the direction of the magnetic force F are different from each other.

In a case where the shape of the cross section of the developer regulating member 43 is a triangle, and if the base of the triangle is b and the height of the triangle is h, the second moment of area Iz in the direction of the developer pressure P and the second moment of area Ix in the direction of the magnetic force F are each represented as follows. In the following description, all second moments of area are with respect to an axis passing through the centroid (corresponding to the center of gravity).

$$Iz = \frac{b^3 h}{48}$$

$$Ix = \frac{bh^3}{36}$$

In a case where the shape of the cross section of the developer regulating member 43 is an isosceles triangle having a base b of 8.5 mm and a height h of 6.5 mm, the second moment of area Iz in the direction of the developer pressure P, the second moment of area Ix in the direction of the magnetic force F, and the cross-sectional area of the developer regulating member 43 are as illustrated in table 2.

TABLE 2

| | [Comparative example] ø6 round bar | [First exemplary embodiment] Triangular prism |
|---|---|---|
| Second moment of area in direction of developer pressure P | 64 | 83 |
| Second moment of area in direction of magnetic force F | 64 | 65 |
| Cross-sectional area of developer regulating member | 28 | 27.5 |

A reduction in the cross-sectional area of the developer regulating member 43 leads to a reduction in the magnetic force F. Further, increases in the second moments of area of the developer regulating member 43 lead to an increase in the stiffness of the developer regulating member 43. That is, the shape of the cross section of the developer regulating member 43 is a triangle, whereby it is possible to make the magnetic force F smaller than in a comparative example where the shape of the cross section of the developer regulating member 43 is a circle. Further, the shape of the cross section of the developer regulating member 43 is a triangle, whereby it is possible to make the second moment of area Iz in the direction of the developer pressure P and the second moment of area Ix in the direction of the magnetic force F larger than in the comparative example where the shape of the cross section of the developer regulating member 43 is a circle. Thus, the shape of the cross section of the developer regulating member 43 is a triangle, whereby it is possible to increase the stiffness of the developer regulating member 43.

To set the shape of the cross section of the developer regulating member 43, it is particularly desirable that the second moment of area Iz in the direction of the developer pressure P should be larger than the second moment of area Ix in the direction of the magnetic force F. In other words, it is desirable that the stiffness of the developer regulating member 43 in the direction of the developer pressure P should be higher than the stiffness of the developer regulating member 43 in the direction of the magnetic force F.

This is because the deformation (bending) of the developer regulating member 43 in the direction of the magnetic force F can be reduced by making the cross-sectional area of the developer regulating member 43 small to weaken the magnetic force F. In contrast, the deformation (bending) of the developer regulating member 43 in the direction of the developer pressure P can be reduced only by making the second moment of area of the developer regulating member 43 large.

In response, in the first exemplary embodiment, the base b of the triangle and the height h of the triangle are set so that the second moment of area Iz of the developer regulating member 43 in the direction of the developer pressure P is larger than the second moment of area Ix of the developer regulating member 43 in the direction of the magnetic force F.

For example, suppose that due to a restriction on the size of the space for supporting in the developing container 44 the developer regulating member 43 of which only both end portions are supported and which is composed of a magnetic material, the size of the cross-sectional area of the developer regulating member 43 composed of a magnetic substance when viewed in a cross section orthogonal to the direction of the rotational axis of the developing sleeve 41 needs to be made smaller than 28 $mm^2$. To prevent the developer regulating member 43 composed of a magnetic substance from bending even if the developer regulating member 43 receives developer pressure or magnetic force, the second moment of area Iz of the developer regulating member 43 in the direction of the developer pressure P and the second moment of area Ix of the developer regulating member 43 in the direction of the magnetic force F have the following values. That is, the magnitude of the second moment of area Iz of the developer regulating member 43 in the direction of the developer pressure P needs to be larger than 70 $mm^4$ (i.e., a magnitude of a tangent direction component of the second moment of area of the developer regulating member with respect to the centroid of the cross section is larger than 70 $mm^4$, the tangent direction component being a component in a tangent direction of the developer bearing member), and the magnitude of the second moment of area Ix of the developer regulating member 43 in the direction of the magnetic force F needs to be larger than 25 $mm^4$ (i.e., a magnitude of a normal direction component of a second moment of area of the developer regulating member with respect to a centroid of the cross section is larger than 25 $mm^4$, the normal direction component being a component in a normal direction of the developer bearing member). The magnitude of the second moment of area of the developer regulating member 43 in the tangent direction of the developing sleeve 41 with respect to the centroid is larger by 1 $mm^4$ or more than the magnitude of the second moment of area of the developer regulating member 43 in the normal direction of the developing sleeve 41 with respect to the centroid. It is more desirable that the magnitude of the second moment of area of the developer regulating member 43 in the tangent direction of the developing sleeve 41 with respect to the centroid should be larger by 5 $mm^4$ or more than the magnitude of the second moment of area of the developer regulating member 43 in the normal direction of the developing sleeve 41 with respect to the centroid.

That is, in the first exemplary embodiment, the base b of the triangle that is the shape of the cross section of the developer regulating member 43 is set to be larger than the height h of the triangle. Further, in the first exemplary embodiment, as illustrated in FIG. 5, the apex portion of the isosceles triangle of the cross section of the developer regulating member 43 is approximately opposed to the magnetic pole N1 (the cut pole) side of the magnet 42. This is because in the cross-sectional area of the developer regulating member 43, the cross-sectional area of a region on the side closer to the magnet 42 (the developing sleeve 41) is smaller than the cross-sectional area of a region on the side further from the magnet 42 (the developing sleeve 41), whereby it is possible to make the magnetic force F small.

With reference to a cross-sectional view in FIG. 8, a description is given below of, in the cross section of the developer regulating member 43, the cross section of the region on the side further from the magnet 42 (the developing sleeve 41) and the cross section of the region on the side closer to the magnet 42 (the developing sleeve 41).

Figure 8:
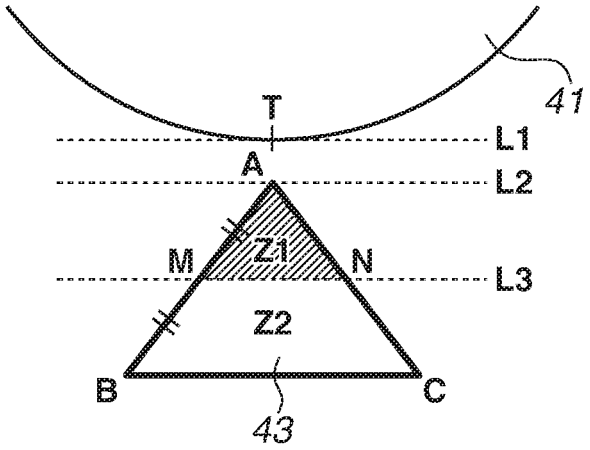
FIG. 8 is a cross-sectional view illustrating the shape of the developer regulating member according to the first exemplary embodiment.

FIG. 8 illustrates a cross-sectional view of the developer regulating member 43 orthogonal to the rotational axis of the developing sleeve 41. A point T on the surface of the developing sleeve 41 is the closest point to the developer regulating member 43. For example, if the cross-sectional shape of the developer regulating member 43 is an isosceles triangle, the point T on the surface of the developing sleeve 41 is a point opposed to the apex portion of the cross-sectional shape of the developer regulating member 43. A point A on the cross section of the developer regulating member 43 is the closest point to the point T on the surface of the developing sleeve 41. A point B on the cross section of the developer regulating member 43 is the furthest point from the point T on the surface of the developing sleeve 41. A straight line L1 is the tangent line of the developing sleeve 41 at the point T on the surface of the developing sleeve 41. A straight line L2 is a parallel line to the straight line L1 and through the point A on the cross section of the developer regulating member 43. A point M on the cross section of the developer regulating member 43 is the midpoint of a segment AB, which connects the points A and B on the cross section of the developing sleeve 41. A straight line L3 is a parallel line to the straight line L1 and through the point M on the cross section of the developer regulating member 43. A point N on the cross section of the developer regulating member 43 is an intersection of a segment AC, which connects the point A on the cross section of the developing sleeve 41 and a point C on the cross section of the developing sleeve 41, and the straight line L3. At this time, the region of the cross section of the developer regulating member 43 is divided into two regions Z1 and Z2 by a segment. MN. The region Z1 refers to the region on the side closer to the developing sleeve 41 (a shaded region illustrated in FIG. 8), and the region Z2 refers to the region on the side further from the developing sleeve 41. The size of the cross-sectional area of the region on the side closer to the developing sleeve 41 (the region Z1 in FIG. 8) is smaller than the size of the cross-sectional area of the region on the side further from the developing sleeve 41 (the region Z2 in FIG. 8).

As described above, the magnetic force F becomes large in proportion to $V\nabla|B|^2$. In this case, $\nabla|B|^2$ depends on the magnetic flux density B generated by the magnet 42. To make $\nabla|B|^2$ small, it is necessary to make the absolute value of |B| small or make a change in |B| (in the direction of the magnetic force F) small.

Figure 7:
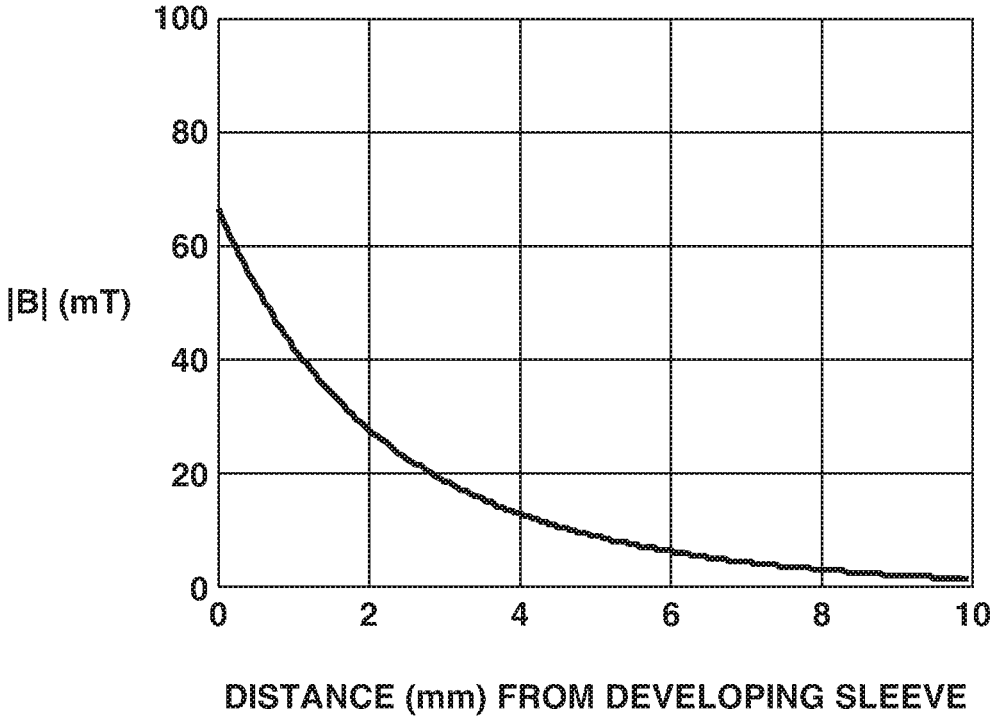
FIG. 7 is a diagram illustrating a change in magnetic flux density in a radial direction of a developing sleeve.

With reference to FIG. 7, a description is given of a change in |B| in the radial direction of the developing sleeve 41 in a case where the developer regulating member 43 is placed in the developing container 44.

As illustrated in FIG. 7, the greater the distance between the developer regulating member 43 and the developing sleeve 41 (i.e., the further away the developer regulating member 43 is from the developing sleeve 41), the smaller the value of |B|, and the smaller the amount of change in |B|. Due to this, in a case where the cross-sectional area of the region on the side closer to the developing sleeve 41 (the region Z1 in FIG. 8) in the developer regulating member 43 is made small, the degree of decrease in the magnetic force F is larger than in a case where the cross-sectional area of the region of the side further from the developing sleeve 41 (the region Z2 in FIG. 8) in the developer regulating member 43 is made small.

In response, in the developer regulating member 43 made of a magnetic substance, the cross-sectional area of the region on the side closer to the developing sleeve (the region Z1 in FIG. 8) in the developer regulating member 43 is made smaller, whereby it is possible to make the magnetic force F smaller. Then, the magnetic force F received by the developer regulating member 43 is made small, whereby it is possible to effectively reduce the deformation (bending) of the developer regulating member 43.

As described above, in the first exemplary embodiment, the shape of the cross section of the developer regulating member 43 is set so that the second moment of area Iz of the developer regulating member 43 in the direction of the developer pressure P is larger than the second moment of area Ix of the developer regulating member 43 in the direction of the magnetic force F. Specifically, the developer regulating member 43 has a triangular prism bar shape, and the shape of the cross section of the developer regulating member 43 is set to be an isosceles triangle.

Consequently, even if the cross-sectional area of the developer regulating member 43 according to the first exemplary embodiment is smaller than that of the developer regulating member 43 indicated as the comparative example where the shape of the cross section is a circle, it is possible to increase the second moment of area Iz of the developer regulating member 43 in the direction of the developer pressure P. This can reduce the deformation (bending) of the developer regulating member 43 in the direction of the developer pressure P.

Further, in a case where the shape of the cross section of the developer regulating member 43 is a triangle, it is possible to make the cross-sectional area of the developer regulating member 43 smaller than in a case where the shape of the cross section of the developer regulating member 43 is a circle. Thus, it is possible to make the magnetic force F received by the developer regulating member 43 small. Further, the cross-sectional area of the region on the side closer to the developing sleeve 41 (the region Z1 in FIG. 8) in the developer regulating member 43 is made smaller than the cross-sectional area of the region on the side further from the developing sleeve 41 (the region Z2 in FIG. 8) in the developer regulating member 43. Consequently, it is possible to make the magnetic force F received by the developer regulating member 43 small. This can reduce the deformation (bending) of the developer regulating member 43 composed of a magnetic substance in the direction of the magnetic force F.

Figure 9:
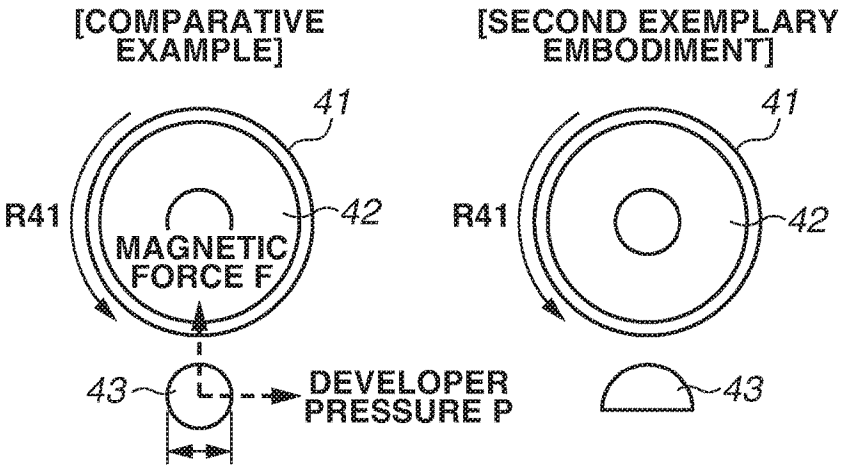
FIG. 9 is a cross-sectional view illustrating a shape of a developer regulating member according to a second exemplary embodiment.

In the first exemplary embodiment, an example has been described where the developer regulating member 43 composed of a magnetic substance has a triangular prism bar shape, and the shape of the cross section of the developer regulating member 43 is an isosceles triangle. On the other hand, in a second exemplary embodiment, a description is given below of an example where, as illustrated in FIG. 9, the developer regulating member 43 composed of a magnetic substance has a semi-cylindrical bar shape, and the shape of the cross section of the developer regulating member 43 is a semicircle. In the second exemplary embodiment, a case is described where the shape of the cross section of the developer regulating member 43 is a complete semicircle. The shape of the cross section of the developer regulating member 43, however, may not need to be a complete semicircle.

As illustrated in FIG. 9, the shape of the cross section of the developer regulating member 43 is a semicircle having a diameter of 8 mm (ø8). Further, an apex portion of the circular shape of the cross section of the developer regulating member 43 is placed to be approximately opposed to the magnetic pole N1 (the cut pole) of the magnet 42.

In a case where the shape of the cross section of the developer regulating member 43 is a semicircle, the second moment of area of the developer regulating member 43 differs depending on the direction. In a case where the shape of the cross section of the developer regulating member 43 is a semicircle, and if the radius of the semicircle is r, a second moment of area Iz of the developer regulating member 43 in the direction of the developer pressure P and a second moment of area Ix of the developer regulating member 43 in the direction of the magnetic force F are each represented as follows.

$$Ix = \frac{(9\pi^2 - 64)r^4}{72\pi} \approx 0.1098r^4$$

$$Iz = \frac{\pi r^4}{8} \approx 0.3927r^4$$

In a case where the shape of the cross section is a semicircle having a diameter of 8 mm (ø8), the second moment of area Iz of the developer regulating member 43 in the direction of the developer pressure P, the second moment of area Ix of the developer regulating member 43 in the direction of the magnetic force F, and the cross-sectional area of the developer regulating member 43 are as illustrated in table 3.

TABLE 3

| | [Comparative example] ø6 round bar | [Second exemplary embodiment] Semi-cylinder |
|---|---|---|
| Second, moment of area in direction of developer pressure P | 64 | 100 |
| Second moment of area in direction of magnetic force F | 64 | 28 |
| Cross-sectional area of developer regulating member | 28 | 25 |

Also in the second exemplary embodiment where the shape of the cross section of the developer regulating member 43 is a semicircle, similarly to the first exemplary embodiment, it is possible to make the cross-sectional area of the developer regulating member 43 smaller than in the comparative example where the shape of the cross section of the developer regulating member 43 is a circle. Further, also in the second exemplary embodiment where the shape of the cross section of the developer regulating member 43 is a semicircle, similarly to the first exemplary embodiment, it is possible to make the second moment of area of the developer regulating member 43 in the direction of the developer pressure P larger than in the comparative example where the shape of the cross section of the developer regulating member 43 is a circle.

Further, in the second exemplary embodiment, similarly to the first exemplary embodiment, the cross-sectional area of the region on the side closer to the developing sleeve 41 in the developer regulating member 43 is smaller than the cross-sectional area of the region on the side further from the developing sleeve 41 in the developer regulating member 43. Thus, in the second exemplary embodiment, similarly to the first exemplary embodiment, it is possible to make the magnetic force F received by the developer regulating member 43 small.

Meanwhile, in the second exemplary embodiment, unlike the first exemplary embodiment, the shape of the cross section of the developer regulating member 43 is a semicircle, whereby the second moment of area of the developer regulating member 43 in the direction of the magnetic force F is smaller than in the comparative example where the shape of the cross section of the developer regulating member 43 is a circle.

As described above, a reduction in the cross-sectional area of the developer regulating member 43 leads to a reduction in the magnetic force F. Then, the deformation (bending) of the developer regulating member 43 in the direction of the magnetic force F can be reduced by making the cross-sectional area of the developer regulating member 43 small to weaken the magnetic force F. In contrast, the deformation (bending) of the developer regulating member 43 in the direction of the developer pressure P can be reduced only by making the second moment of area of the developer regulating member 43 large. Meanwhile, also in the second exemplary embodiment, similarly to the first exemplary embodiment, the second moment of area Iz in the direction of the developer pressure P is larger than the second moment of area Ix in the direction of the magnetic force F.

Thus, the second exemplary embodiment where the cross-sectional shape of the developer regulating member 43 composed of a magnetic substance is a semicircle has the effect of reducing the deformation (bending) of the developer regulating member 43 in the direction of the developer pressure P, while reducing the deformation of the developer regulating member 43 in the direction of the magnetic force F, as compared with the comparative example where the cross-sectional shape of the developer regulating member 43 is a circle. However, the effect of reducing the deformation of the developer regulating member 43 when the developer regulating member 43 receives the developer pressure P or the magnetic force F is greater in the first exemplary embodiment where the shape of the cross section of the developer regulating member 43 is a triangle, than in the second exemplary embodiment where the shape of the cross section of the developer regulating member 43 is a semicircle.

Figure 10:
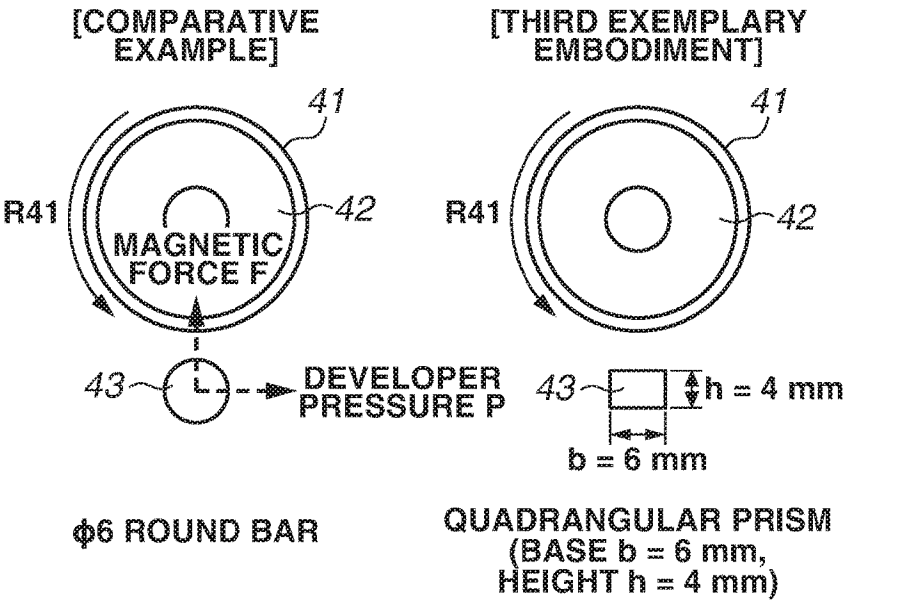
FIG. 10 is a cross-sectional view illustrating a shape of a developer regulating member according to a third exemplary embodiment.

In a third exemplary embodiment, a description is given below of an example where, as illustrated in FIG. 10, the developer regulating member 43 composed of a magnetic substance has a quadrangular prism bar shape, and the shape of the cross section of the developer regulating member 43 is a rectangle (an oblong).

In a case where the shape of the cross section of the developer regulating member 43 is a rectangle, and if the base of the rectangle is b and the height of the rectangle is h, a second moment of area Iz of the developer regulating member 43 in the direction of the developer pressure P and a second moment of area Ix of the developer regulating member 43 in the direction of the magnetic force F are represented as follows.

$$Iz = \frac{b^3 h}{12}$$

$$Ix = \frac{bh^3}{12}$$

In a case where the shape of the cross section of the developer regulating member 43 is a rectangle having a base b of 6 mm and a height h of 4 mm, the second moment of area Iz of the developer regulating member 43 in the direction of the developer pressure P and the second moment of area Ix of the developer regulating member 43 in the direction of the magnetic force F are illustrated in table 4. Further, the cross-sectional area of the developer regulating member 43 in this case is as illustrated in table 4.

TABLE 4

| | [Comparative example] ø6 round bar | [Third exemplary embodiment] Quadrangular prism |
|---|---|---|
| Second, moment of area in direction of developer pressure P | 64 | 72 |
| Second moment of area in direction of magnetic force F | 64 | 32 |
| Cross-sectional area of developer regulating member | 28 | 24 |

The base b of the rectangle that is the shape of the cross section of the developer regulating member 43 is made larger than the height h of the rectangle, whereby it is possible to make the second moment of area of the developer regulating member 43 in the direction of the developer pressure P larger than in the comparative example where the shape of the cross section of the developer regulating member 43 is a circle.

Further, also in the third exemplary embodiment where the shape of the cross section of the developer regulating member 43 is a rectangle, similarly to the first exemplary embodiment, it is possible to make the cross-sectional area of the developer regulating member 43 smaller than in the comparative example where the shape of the cross section of the developer regulating member 43 is a circle. In the third exemplary embodiment, however, unlike the first exemplary embodiment, the cross-sectional area of the region on the side further from the developing sleeve 41 in the developer regulating member 43 is the same as the cross-sectional area of the region on the side closer to the developing sleeve 41 in the developer regulating member 43.

Meanwhile, in the third exemplary embodiment, unlike the first exemplary embodiment, the shape of the cross section of the developer regulating member 43 is a rectangle, whereby the second moment of area of the developer regulating member 43 in the direction of the magnetic force F is smaller than in the comparative example where the shape of the cross section of the developer regulating member 43 is a circle. Meanwhile, also in the third exemplary embodiment, similarly to the first exemplary embodiment, the second moment of area Iz in the direction of the developer pressure P is larger than the second moment of area Ix in the direction of the magnetic force F.

Thus, the third exemplary embodiment where the cross-sectional shape of the developer regulating member 43 composed of a magnetic substance is a rectangle has the effect of reducing the deformation (bending) of the developer regulating member 43 in the direction of the developer pressure P, while reducing the deformation of the developer regulating member 43 in the direction of the magnetic force F, as compared with the comparative example where the cross-sectional shape of the developer regulating member 43 is a circle. However, the effect of reducing the deformation of the developer regulating member 43 when the developer regulating member 43 receives the developer pressure P or the magnetic force F is greater in the first and second exemplary embodiments than in the third exemplary embodiment.

As described above, the cross-sectional area of the developer regulating member 43 is made small, whereby it is possible to make the magnetic force F received by the developer regulating member 43 small. In response, a hollow portion is provided in the developer regulating member 43, whereby it is possible to make the cross-sectional area of the developer regulating member 43 smaller than in a case where the hollow portion is not provided in the developer regulating member 43.

Figure 11:
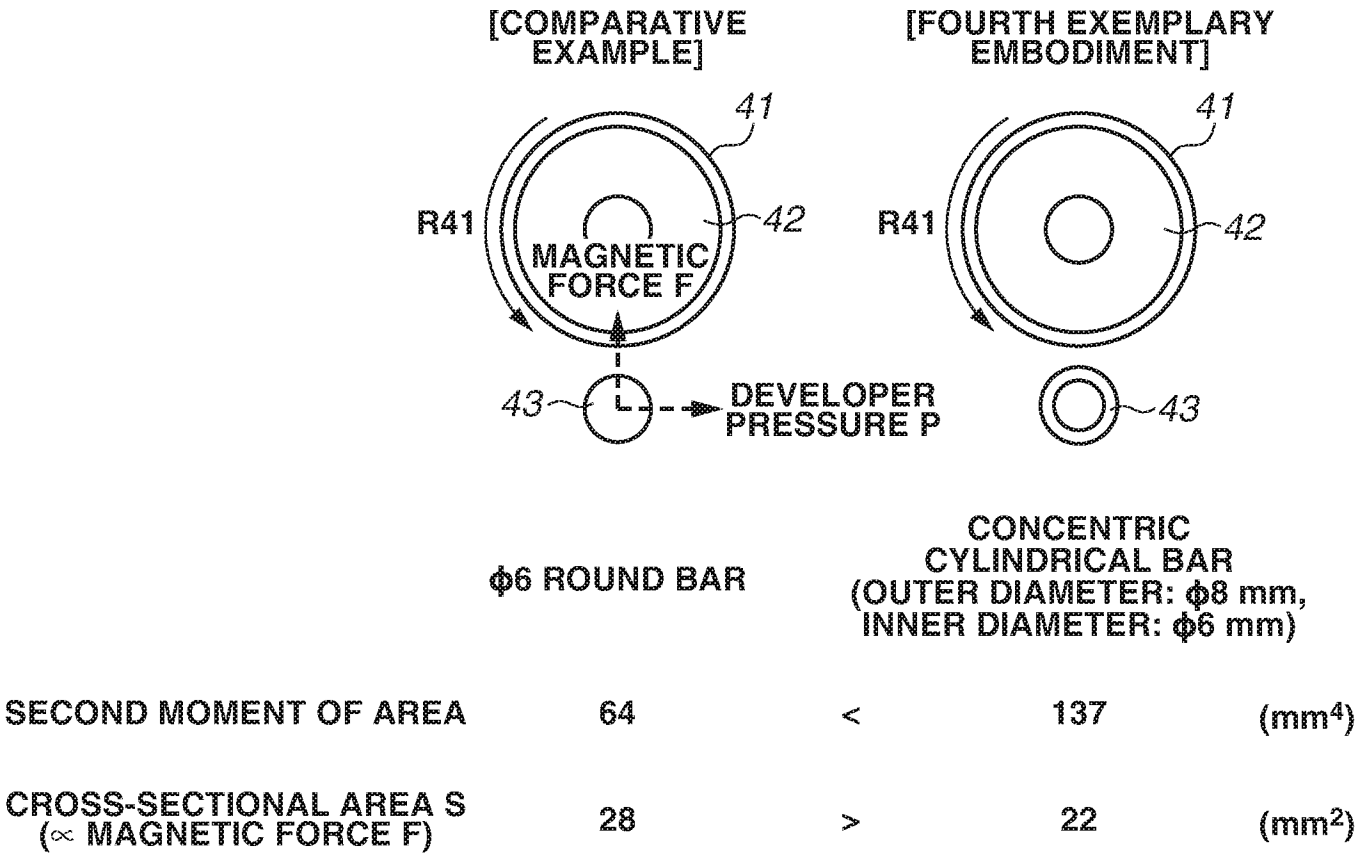
FIG. 11 is a cross-sectional view illustrating a shape of a developer regulating member according to a fourth exemplary embodiment.

In a fourth exemplary embodiment, a description is given of an example where, as illustrated in FIG. 11, the developer regulating member 43 is cylindrical bar (a concentric cylindrical bar) including a cylindrical hollow portion, and the cross section of the developer regulating member 43 is a hollow circle including a circular (concentric circular) hollow portion. The position of the center of the circle of the hollow portion and the position of the center of the circle of the cross section of the developer regulating member 43 are the same as each other. As described above, in the developer regulating member 43 of which the cross section is a hollow circle including a circular hollow portion and in which the circle of the hollow portion and the circle of the cross section of the developer regulating member 43 have a concentric circle relationship, if the outer diameter of the developer regulating member 43 is D and the inner diameter of the developer regulating member 43 is d, a second moment of area I is represented as follows.

$$I = \frac{\pi (D^4 - d^4)}{64}$$

In the fourth exemplary embodiment, the outer diameter D of the cylindrical bar is 8 mm, and the inner diameter d of the cylindrical bar is 6 mm. The second moment of area I and the cross-sectional area of the developer regulating member 43 in this case are as illustrated in table 5.

TABLE 5

| | [Comparative example] ø6 round bar | [Fourth exemplary embodiment] Concentric cylindrical bar |
|---|---|---|
| Second moment of area | 64 | 137 |
| Cross-sectional area | 28 | 22 |

A hollow portion is provided in the developer regulating member 43, whereby it is possible to make the second moment of area larger and also make the cross-sectional area of the developer regulating member 43 smaller than in a case where the hollow portion is not provided in the developer regulating member 43. Thus, the hollow portion is provided in the developer regulating member 43, whereby it is possible to make the magnetic force F received by the developer regulating member 43 smaller than in a case where the hollow portion is not provided in the developer regulating member 43. Thus, the fourth exemplary embodiment has the effect of reducing the deformation (bending) of the developer regulating member 43.

In the fourth exemplary embodiment, a description has been given using as an example the developer regulating member 43 that is a concentric cylindrical bar obtained y providing in a cylindrical bar shape a circular hollow portion formed in a concentric circle. Aspects of the present invention, however, are not limited to this. Alternatively, aspects of the present invention may be applied to the developer regulating member 43 obtained by providing a cylindrical hollow portion formed in a concentric circle in each of the triangular prism, semicircular, and quadrangular prism bar shapes as described in the first, second, and third exemplary embodiments.

As described above, the cross-sectional area of the region on the side closer to the developing sleeve 41 in the developer regulating member 43 is made smaller than the cross-sectional area of the region on the side further from the developing sleeve 41 in the developer regulating member 43, whereby it is possible to make the magnetic force F received by the developer regulating member 43 small.

Figure 12:
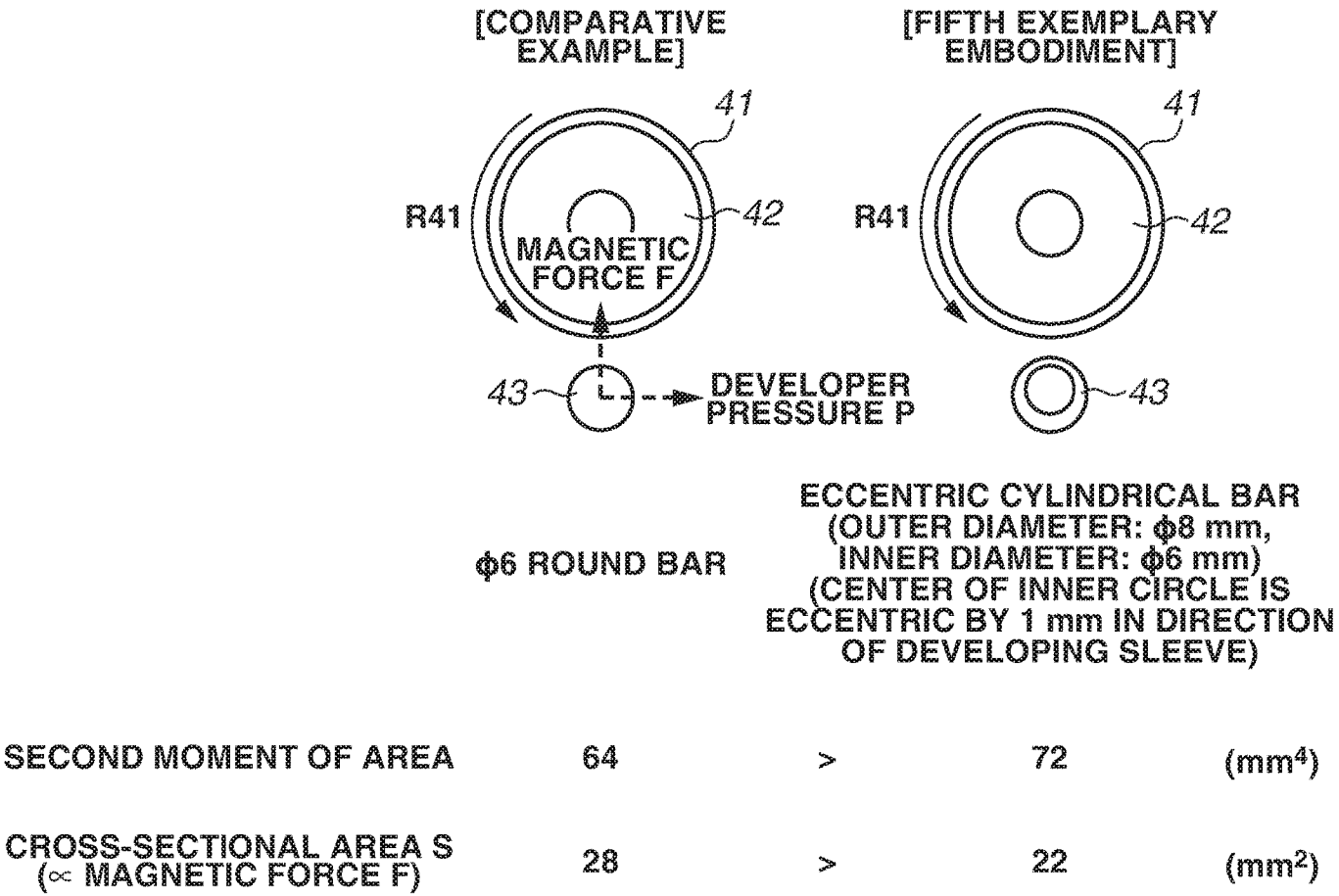
FIG. 12 is a cross-sectional view illustrating a shape of a developer regulating member according to a fifth exemplary embodiment.

In response, in a fifth exemplary embodiment, a description is given of an example where, as illustrated in FIG. 12, the developer regulating member 43 a cylindrical bar (an eccentric cylindrical bar) including a cylindrical hollow portion, and the cross section of the developer regulating member 43 is a hollow circle including a circular (eccentric circular) hollow portion. The position of the center of the circle of the hollow portion and the position of the center of the circle of the cross section of the developer regulating member 43 are different from each other. That is, the hollow portion (the inner circle) is provided by being shifted 1 mm in the normal direction of the developing sleeve 41.

As described above, the cross section of the developer regulating member 43 according to the fifth exemplary embodiment is a hollow circle including a circular hollow portion, and the circle of the hollow portion and the circle of the cross section of the developer regulating member 43 have an eccentric circle relationship. As described above, in the developer regulating member 43 that is a cylindrical bar (an eccentric cylindrical bar) of which the inner circle is eccentric, if the outer diameter of the developer regulating member 43 is D, the inner diameter of the developer regulating member 43 is d, and the amount of eccentricity is c, a second moment of area Ix of the developer regulating member 43 in the direction of the magnetic force F is represented as follows.

$$Ix = \frac{\pi}{4}(D^4 - d^4) - \pi c^2 \frac{a^2 b^2}{a^2 - b^2}$$

In the fifth exemplary embodiment, the outer diameter D of the cylindrical bar is 8 mm, the inner diameter d of the cylindrical bar is c mm, and the amount of eccentricity c of the hollow portion (the inner circle) is 1 mm. The second moment of area I of the developer regulating member 43 and the cross-sectional area of the developer regulating member 43 in this case are as illustrated in table 6.

TABLE 6

| | [Comparative example] ø6 round bar | [Fifth exemplary embodiment] Eccentric cylindrical bar |
|---|---|---|
| Second moment of area | 64 | 72 |
| Cross-sectional area | 28 | 22 |

An eccentric cylindrical hollow portion is provided in the developer regulating member 43, whereby it is possible to make the second moment of area of the developer regulating member 43 larger than in a case where the eccentric cylindrical hollow portion is not provided in the developer regulating member 43. Further, the eccentric cylindrical hollow portion is provided in the developer regulating member 43, whereby it is possible to make the cross-sectional area of the developer regulating member 43 smaller than in a case where the eccentric cylindrical hollow portion is not provided in the developer regulating member 43. Thus, the eccentric cylindrical hollow portion is provided in the developer regulating member 43, whereby it is possible to make the magnetic force F received by the developer regulating member 43 smaller than in a case where the eccentric cylindrical hollow portion is not provided in the developer regulating member 43. Thus, the fifth exemplary embodiment has the effect of reducing the deformation (bending) of the developer regulating member 43.

Further, in the developer regulating member 43 according to the fifth exemplary embodiment, a cylindrical hollow portion formed in an eccentric circle is provided in the developer regulating member 43 so that the cross-sectional area of the region on the side closer to the developing sleeve 41 is smaller than the cross-sectional area of the region on the side further from the developing sleeve 41. Thus, it is possible to make the magnetic force F received by the developer regulating member 43 smaller than in the fourth exemplary embodiment where a cylindrical hollow portion formed in a concentric circle is provided. Thus, it is possible to reduce the deformation (bending) of the developer regulating member 43 composed of a magnetic substance in the direction of the magnetic force F.

In a case where an eccentric cylindrical hollow portion is provided in the developer regulating member 43, similarly to the first exemplary embodiment, the second moment of area Iz in the direction of the developer pressure P is larger than the second moment of area Ix in the direction of the magnetic force F.

Thus, the fifth exemplary embodiment where an eccentric circular hollow portion is provided in a round bar of the develop regulating member 43 composed of a magnetic substance has the effect of reducing the deformation (bending) in the direction of the developer pressure P, while reducing the deformation of the developer regulating member 43 in the direction of the magnetic force F, as compared with the comparative example where the shape of the cross section of the developer regulating member 43 is a circle. Further, the effect of reducing the deformation of the developer regulating member 43 when the developer regulating member 43 receives the developer pressure P or the magnetic force F is greater in the configuration in which a cylindrical hollow portion formed in an eccentric circle is provided (the fifth exemplary embodiment), than in the configuration in which a cylindrical hollow portion formed in a concentric circle is provided (the fourth exemplary embodiment).

In the fifth exemplary embodiment, a description has been given using as an example the developer regulating member 43 that is an eccentric cylindrical bar obtained by providing in cylindrical bar shape a circular hollow portion formed in an eccentric circle. Aspects of the present invention, however, are not limited to this. Alternatively, aspects of the present invention may be applied to the developer regulating member 43 obtained by providing a cylindrical hollow portion formed in an eccentric circle in each of the triangular prism, semicircular, and quadrangular prism bar shapes as described in the first, second, and third exemplary embodiments.

Figure 13:
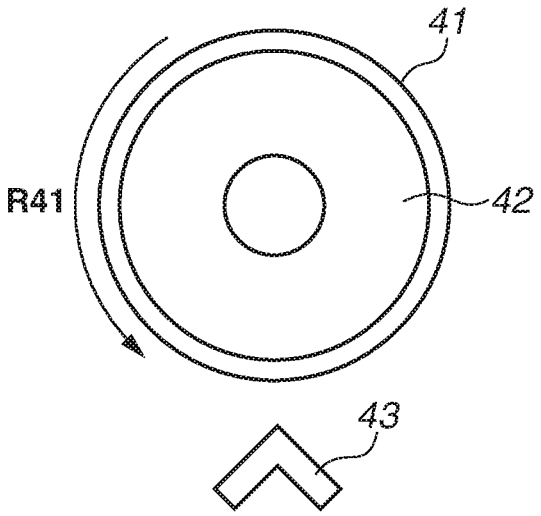
FIG. 13 is a cross-sectional view illustrating a shape of a developer regulating member according to another exemplary embodiment.

As a variation, a configuration may be employed in which, as illustrated in FIG. 13, a recessed portion is provided in the developer regulating member 43, instead of providing a circular hollow portion formed in an eccentric circle in the developer regulating member 43. The recessed portion is provided in the developer regulating member 43, whereby it is possible to make the cross-section area of the developer regulating member 43 smaller and also make the second moment of area of the developer regulating member 43 larger than those of the developer regulating member 43 in which the recessed portion is not provided. However, the effect of reducing the deformation of the developer regulating member 43 when the developer regulating member 43 receives the developer pressure P or the magnetic force F is greater in the configuration in which a circular hollow portion formed in an eccentric circle is provided in the developer regulating member 43, than in the configuration in which a recessed portion is provided in the developer regulating member 43.

Other Exemplary Embodiments

Aspects of the present invention are not limited to the above exemplary embodiments. Various modifications (including the organic combinations of the exemplary embodiments) can be made based on the spirit of the present invention, but are not excluded from the scope of the present invention.

In the above exemplary embodiments, a description has been given using an example the image forming apparatus having a configuration in which, as illustrated in FIG. 1, the intermediate transfer belt 62 is used as an image bearing member. Aspects of the present invention, however, are not limited to this. Aspects of the present invention can also be applied to the image forming apparatus having a configuration in which a recording material is brought into direct contact with the photosensitive drums 1 (1A, 1B, 1C, 1D) in order, thereby transferring images. In this case, each photosensitive drum 1 (1A, 1B, 1C, 1D) forms a rotatable image bearing member for bearing a toner image.

Further, in the above exemplary embodiments, a description has been given using as an example the developing device 4 having a configuration in which, illustrated in FIG. 2, the developing sleeve 41 rotates counterclockwise (in the direction of the arrow R41 illustrated in FIG. 2), and the developer regulating member 43 is disposed below the developing sleeve 41. Aspects of the present invention, however, are not limited to this. Aspects of the present invention can also be applied to the developing device 4 having a configuration in which the developing sleeve 41 rotates clockwise, and the developer regulating member 43 is disposed above the developing sleeve 41.

Further, in the above exemplary embodiments, a description has been given using as an example the developing device 4 having a configuration in which, as illustrated in FIG. 2, the developing chamber 44*a* and the agitation chamber 44*b* are disposed to be arranged side y side in the horizontal direction. Aspects of the present invention, however, are not limited to this. Aspects of the present invention can also be applied to the developing device 4 having a configuration in which the developing chamber 44*a* and the agitation chamber 44*b* are disposed to be arranged one above the other in the direction of gravity.

While aspects of the present invention have been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-177990, filed Sep. 12, 2016, and No. 2017-137180, filed Jul. 13, 2017, which are hereby incorporated by reference herein in their entirety.

What is claimed is:

1. A developing device comprising:

a developing container configured to store developer including toner and a carrier;

a developer bearing member rotatably provided and configured to bear the developer to develop an electrostatic latent image formed on an image bearing member;

a magnet fixedly placed within the developer bearing member and configured to generate a magnetic field for the developer bearing member to bear the developer; and a developer regulating member placed not in contact with the developer bearing member so as to be opposed to the developer bearing member, configured to be magnetized by an external magnetic field, and configured to regulate an amount of developer borne on the developer bearing member, wherein only both end portions of the developer regulating member are supported by the developing container such that the developer regulating member cannot rotate, and wherein, in a cross section of the developer regulating member orthogonal to a rotational axis of the developer bearing member, the following are satisfied:

an area of the cross section of the developer regulating member is smaller than 28 $mm^2$;

a magnitude of a normal direction component of a second moment of area of the developer regulating member with respect to a centroid of the cross section is larger than 25 $mm^4$, the normal direction component being a component in a normal direction of the developer bearing member; and a magnitude of a tangent direction component of the second moment of area of the developer regulating member with respect to the centroid of the cross section is larger than 70 $mm^4$, the tangent direction component being a component in a tangent direction of the developer bearing member.

2. The developing device according to claim 1, wherein, in the cross section of the developer regulating member orthogonal to the rotational axis of the developer bearing member, the magnitude of the tangent direction component of the second moment of area of the developer regulating member with respect to the centroid of the cross section is larger than the magnitude of the normal direction component of the second moment of area of the developer regulating member with respect to the centroid of the cross section by 1 $mm^4$ or more.

3. The developing device according to claim 2, wherein, in the cross section of the developer regulating member orthogonal to the rotational axis of the developer bearing member, the magnitude of the tangent direction component of the second moment of area of the developer regulating member with respect to the centroid of the cross section is larger than the magnitude of the normal direction component of the second moment of area of the developer regulating member with respect to the centroid of the cross section by 5 $mm^4$ or more.

4. The developing device according to claim 1, wherein, in the cross section of the developer regulating member orthogonal to the rotational axis of the developer bearing member, the magnitude of the normal direction component of the second moment of area of the developer regulating member with respect to the centroid of the cross section is smaller than 64 $mm^4$.

5. The developing device according to claim 1, wherein the developer regulating member is made of a metal.

6. A developing device comprising:

a developing container configured to contain a developer comprising toner and carrier;

a rotatable developing member configured to carry and feed the developer to a position where an electrostatic image formed on an image bearing member is developed; and a developer regulating member attached to the developing container and disposed opposed to the rotatable developing member, made of metal, and configured to regulate an amount of the developer carried on the rotatable developing member;

wherein the developer regulating member is attached to the developing container in a state in which only both ends in a longitudinal direction of the developer regulating member are supported by the developing container, and wherein, in a cross section of the developer regulating member orthogonal to a rotation axis of the rotatable developing member, an area of the cross section of the developer regulating member is smaller than 28 $mm^2$, and a magnitude of a tangent direction component of a second moment of area of the developer regulating member with respect to the centroid of the cross section is larger than 70 $mm^4$, the tangent direction component being a component in a tangent direction of the developer bearing member.

7. The developing device according to claim 6, wherein, in the cross section of the developer regulating member orthogonal to the rotational axis of the rotatable developing member, a magnitude of a normal direction component of the second moment of area of the developer regulating member with respect to the centroid of the cross section is smaller than 64 $mm^4$, the normal direction component being a component in a normal direction of the developer bearing member.

8. The developing device according to claim 7, wherein, in the cross section of the developer regulating member orthogonal to the rotational axis of the rotatable developing member, the magnitude of the normal direction component of the second moment of area of the developer regulating member with respect to the centroid of the cross section is larger than 25 $mm^4$.

9. The developing device according to claim 6, wherein wherein, in the cross section of the developer regulating member orthogonal to the rotational axis of the rotatable developing member, the magnitude of the tangent direction component of the second moment of area of the developer regulating member with respect to the centroid of the cross section is larger than a magnitude of a normal direction component of the second moment of area of the developer regulating member with respect to the centroid of the cross section by 1 $mm^4$ or more, the normal direction component being a component in a normal direction of the developer bearing member.

10. The developing device according to claim 9, wherein, in the cross section of the developer regulating member orthogonal to the rotational axis of the rotatable developing member, the magnitude of the tangent direction component of the second moment of area of the developer regulating member with respect to the centroid of the cross section is larger than the magnitude of the normal direction component of the second moment of area of the developer regulating member with respect to the centroid of the cross section 5 $mm^4$ or more.

11. The developing device according to claim 6, wherein the developer regulating member is magnetic.

* * * * *